US012757961B2

(12) United States Patent
Thompson et al.

(10) Patent No.: US 12,757,961 B2
(45) Date of Patent: Oct. 13, 2026

(54) MOISTURE WICKING AND ABSORBING HEADBAND OR HEADWEAR INSERT

(71) Applicant: Zephyros, Inc., Romeo, MI (US)

(72) Inventors: Greg Thompson, Simpsonville, SC (US); Blake Synnestvedt, Bloomfield Hills, MI (US); Kendall Bush, Rochester Hills, MI (US); Ronald G. Bogert, Brown City, MI (US)

(73) Assignee: Zephyros, Inc., Romeo, MI (US)

( * ) Notice: Subject to any disclaimer, the term of this patent is extended or adjusted under 35 U.S.C. 154(b) by 0 days.

(21) Appl. No.: 18/017,457

(22) PCT Filed: Jul. 26, 2021

(86) PCT No.: PCT/US2021/043133

§ 371 (c)(1),
(2) Date: Jan. 23, 2023

(87) PCT Pub. No.: WO2022/020797

PCT Pub. Date: Jan. 27, 2022

(65) Prior Publication Data

US 2023/0276889 A1 Sep. 7, 2023

Related U.S. Application Data

(60) Provisional application No. 63/056,154, filed on Jul. 24, 2020, provisional application No. 63/105,484, filed on Oct. 26, 2020.

(51) Int. Cl.
*A42B 3/12* (2006.01)
*A41D 31/12* (2019.01)

(52) U.S. Cl.
CPC ..... *A42B 3/128* (2013.01); *A41D 31/125* (2019.02)

(58) Field of Classification Search
CPC ..... A41D 31/125; A42C 5/02; A42C 5/04
(Continued)

(56) References Cited

U.S. PATENT DOCUMENTS 2,051,714 A 8/1936 Huntington
5,313,668 A * 5/1994 Bogan ..... A42C 5/02 2/209.13

(Continued)

FOREIGN PATENT DOCUMENTS

WO 2017/200973 A1 11/2017
WO 2019/126506 A1 6/2019

OTHER PUBLICATIONS

International Search Report and Written Opinion dated Nov. 8, 2021, for International Application PCT/US2021/043133.

(Continued)

*Primary Examiner* — Katherine M Moran
(74) *Attorney, Agent, or Firm* — The Dobrusin Law Firm, P.C.

(57) ABSTRACT

An article to be worn on or around the head for absorbing and/or wicking perspiration. The article may include an elongated body portion and one or more extension features extending from the body portion for guiding absorption and/or evaporation of moisture. The article may be formed of a larger material adapted to provide greater coverage to a wearer's head. The article (10) is formed of: an interior layer (14) adapted to contact a source of moisture; a vertically lapped fibrous layer (12); and an exterior layer (16); wherein the fibrous layer (12) is sandwiched between the interior layer (14) and the exterior layer (16).

20 Claims, 19 Drawing Sheets

(58) Field of Classification Search
USPC ..... 2/171, 181, 183, 172
See application file for complete search history.

(56) References Cited

U.S. PATENT DOCUMENTS

| | | | | |
|---|---|---|---|---|
| 6,567,991 | B1 | 5/2003 | Holslag et al. | |
| 6,603,054 | B2 | 8/2003 | Chen et al. | |
| 7,497,097 | B2 * | 3/2009 | Herr | D04B 21/12 66/170 |
| 9,392,827 | B2 * | 7/2016 | Farney | A41D 20/00 |
| 10,561,546 | B2 | 2/2020 | Rosati et al. | |
| 10,648,110 | B2 | 5/2020 | Kramkowski et al. | |
| 11,186,063 | B2 * | 11/2021 | Piana | D04H 1/76 |
| 11,432,603 | B2 * | 9/2022 | Kelly | A42C 5/02 |
| 11,606,994 | B2 * | 3/2023 | Thompson | B32B 5/266 |
| 2009/0077716 | A1 | 3/2009 | Farney | |
| 2012/0036613 | A1 | 2/2012 | Calon et al. | |
| 2013/0185843 | A1 | 7/2013 | Rahm | |
| 2015/0059055 | A1 | 3/2015 | Johnson et al. | |
| 2016/0255897 | A1 * | 9/2016 | Johnson | A61F 13/622 |
| 2019/0142082 | A1 | 5/2019 | Nordstrom et al. | |
| 2021/0146287 | A1 * | 5/2021 | Thompson | B01D 39/2082 |

OTHER PUBLICATIONS

Baker et al., "Body map of regional vs. whole body sweating rate and sweat electrolyte concentrations in men and women during moderate exercise-heat stress", J. Appl. Physiol., (2018), vol. 214, p. 1304-18.

* cited by examiner

MOISTURE WICKING AND ABSORBING HEADBAND OR HEADWEAR INSERT

FIELD

The present teachings generally relate to a material for providing moisture wicking and absorption, and more particularly, to a moisture wicking and absorbing headband or headwear pad or insert.

BACKGROUND

The face and scalp have a high density of sweat glands, and perspiring is the body's natural response to elevated body temperatures and external temperatures. During physical activity, or when spending time in warmer conditions, people have a tendency to perspire more heavily. It is not uncommon for droplets of sweat to run down someone's forehead or face during physical exertion or warm conditions.

Cyclists, for example, are constantly seeking new ways to absorb perspiration in efforts to keep sweat from dripping into their eyes or down their faces. Cyclists also experience frustration with sweat droplets falling onto the arms of their glasses (e.g., sunglasses, cycling glasses) and being directed to the lens portion of the glasses, thereby affecting vision and safety.

Current cycling helmets are designed to provide air flow and a cooling effect to the wearer via air vents or openings within the helmet. However, an issue still remains with sweat dripping onto the rider's face and into the rider's eyes. Similar issues exist, or are even further exacerbated, for other helmets with less air flow, such as motorcycle helmets, especially when worn in warmer climates. Riders then resort to materials such as sweatbands or wicking headbands. These products become quickly saturated and exceed the saturation point, and the moisture absorbed does not evaporate quickly enough, so the issue of sweat droplets getting into a rider's eyes remains. Additionally, these products are essentially two-dimensional, so they do not provide padding to the helmet, which can make wearing the helmet uncomfortable. Current helmet designs also use polyurethane foams as padding material. This material does not absorb sweat, so while it may provide some cushioning, the padding does not address the issue of sweat dripping into the rider's face and eyes. Other absorbing products are single-use products that are intended to be discarded and cannot be reused or washed.

Typical materials used for providing moisture resistance or moisture absorption include closed cell foams, cross-lapped felts, or materials having a horizontal fiber orientation. However, while these materials may absorb moisture, they often have poor breathability, resulting in the absorbed moisture remaining in the material, promoting the growth of fungi or bacteria and causing odor. These materials may be heavy and hot for a wearer, thereby causing and accumulating more sweat. Additionally, these materials tend to have poor resiliency in applications requiring heightened stress on the material. Clothing materials, for example, typically use nylon or polyester alone to provide a sweat wicking material. However, these materials often provide poor resilience or breathability, making it uncomfortable for users that wear the clothing. These materials are often difficult to clean and may even gain weight over time due to the building up of moisture, mildew, and the like.

Therefore, there is a need for a product that provides cushioning while providing moisture absorption and wicking properties. There is a need for a material that is breathable. There is a need for a material that provides antimicrobial, antifungal, anti-odor, or mildew resistant properties.

SUMMARY

The present teachings meet one or more of the above needs by the improved devices and methods described herein. The present teachings include a material that may provide cushioning, comfort, the ability to clean, or a combination thereof. The present teachings include a material that provides structure resiliency; comfortable product feel; moisture wicking; odor reduction or inhibition; cooling effect to the wearer; quick drying properties; cleanability and/or washability; durability; capability to be formed into three-dimensional shapes; or a combination thereof.

The material provides comfortable cushioning with a combination of attributes to address both the need for padding inside headwear, such as a helmet, and for a mechanism to wick sweat from the wearer's forehead. The three-dimensional wicking structure works in combination with the headwear design to provide air flow to dry the sweat as it is pulled away from the wearer's forehead. The material may be antimicrobial and eliminate odors caused by sweat while also being machine washable to keep the product fresh and reusable.

The present teachings relate to a multilayered material for guiding absorption and/or evaporation of moisture. The multilayered material may include any combination of an interior layer adapted to contact a source of moisture; a vertically lapped fibrous layer; and an exterior layer. The fibrous layer may be sandwiched between the interior layer and the exterior layer. The multilayered material may function to absorbs and/or wick away perspiration. The interior layer, exterior layer, or both, may be a wicking layer. The loops of the vertically lapped structure may extend generally perpendicularly to the longitudinal axis of the article, generally perpendicular to the machine direction, or both. Prior to lapping, the fibrous layer may be formed of a carded web with fibers oriented in the machine direction. The general direction of the fibers may be generally perpendicular to the direction of the loops of the vertically lapped structure (e.g., when viewing the fibers from the top surface).

The material may be used to contact a source of moisture, such as a head, scalp, face, forehead, or combination thereof. The material may be adapted to be worn with and/or inserted into headwear. For example, the material may be an insert for a helmet. The material may be integrated into a helmet. The material may provide cushioning. The material may be washable without losing shape, resilience, wicking properties, drying properties antimicrobial properties, or a combination thereof. The material may exhibit antimicrobial characteristics, antifungal characteristics, or both. The material may be mold or mildew resistant. The material may be flexible. The material may be reusable. The material may be odor-resistant. The material may have a Sweat Management Index of about 50 or greater.

The material may be a shaped three-dimensional structure. The material, or one or more layers thereof, may be thermoformable to allow the material to be formed into a desired shape. The edges of the material may be compressed and heat sealed to bond the layers together. The edges of the interior layer and exterior layer may be sealed to encapsulate the fibrous layer. One or more of the layers may be laminated together to form a laminated product prior to any additional shaping or molding steps.

The material may include an elongated body portion. One or more extension features may extend from the body portion for guiding absorption and/or evaporation of moisture. For example, an extension feature may be a ridge extending from an edge of the body portion. The ridge may be adapted to extend toward the crown of a user's head. The extension feature may be one or more tabs extending from an edge of the body portion. The tabs may be adapted to be positioned at or near temples of a user's head. The one or more tabs may be positioned between a user's head and a portion of an article of eyewear (e.g., arms of glasses or strap of goggles). The one or more tabs may be are adapted to contact a portion of an article of eyewear (e.g., arms of glasses or strap of goggles).

The present teachings also contemplate an article of headwear including the material as described herein. The article of headwear may be a headband. The headband may include one or more straps for securing the headband. The article of headwear may be a helmet, such as a cycling helmet or motorsports helmet (e.g., motorcycling helmet, dirtbiking helmet, all-terrain vehicle helmet).

DETAILED DESCRIPTION

Figure 1:
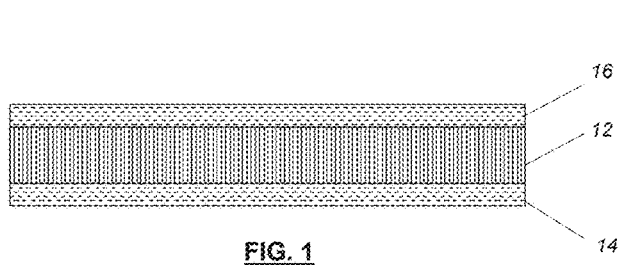
FIG. 1 is a cross-sectional view of a layered material in accordance with the present teachings.

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the description herein, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

While discussed in the context of cycling and helmets, it is possible for the materials described herein to be used with any type of headwear, including but not limited to, sporting helmets (e.g., hockey helmets, baseball helmets, jockey helmets, polo helmets, rock climbing helmets, motorsports helmets (e.g., motorcycle helmets, all-terrain vehicle helmets, dirtbike helmets), skiing/snowboarding helmets, football helmets, car racing helmets, softball helmets, lacrosse helmets, cricket helmets, wrestling or martial arts headgear, in-line skating helmets, skateboarding helmets, and the like), other protective headgear (e.g., firefighter helmet, hard hat), other headwear (e.g., baseball caps, baby helmets, beanies), or as a partial head (e.g., crown of head, hairline, forehead) covering or in conjunction with a partial head covering (e.g., a headband, visor). The materials described herein may be used as padding for helmets, where the material covers a greater area of the head, including the back of the head, sides of the head, crown of the head, forehead, or a combination thereof.

These materials may also provide additional benefits such as compression resilience and puncture resistance, protection (e.g., by providing cushioning), breathability, padding, moisture transference (e.g., moisture is moved from a surface of a user through the material), odor inhibition, cooling effects, insulative effects, reduction of drag, or a combination thereof. The material may be shaped to fit the area to which it will be worn or used. For example, a pad for insertion into a helmet may be shaped to wrap around at least a portion of a wearer's forehead, head, scalp, or a combination thereof. The material may also be soft feeling, lightweight, washable, reusable, or a combination thereof. For example, the materials may give a balance of drag reduction, cooling, insulating, sweat management, and improved comfortable fit of the article of headwear, such as a helmet, on a head. This can be achieved through a full head covering or partial head covering.

The materials as described herein may especially provide improved comfort to the wearer. The materials may provide cushioning at contact points between an article of headwear, such as a helmet, and a head. The materials may provide cushioning at a wearer's forehead. The materials may provide cushioning anywhere a helmet may cover, including a crown of the head, back of the head, side of the head, and even at the cheek, jaw, chin, or mouth in a full-coverage helmet, such as a motorcycle helmet or other motorsports helmet. The soft cushioning and resilient properties improve the comfort and durability of the material, as compared with traditional cushioning materials, such as polyurethane foam materials. Polyurethane foam materials tend to break down over time under normal outdoor conditions and must be replaced frequently. The materials described herein are more durable than polyurethane foam products, thereby saving cost and time replacing foam inserts. Polyurethane foam is also a thermoset material that breaks down faster in hydrophilic conditions. Washing this material expedites the breakdown. The materials described herein may allow for a washable, reusable product with a usable life that exceeds that of a traditional cushioning material, such as polyurethane foam.

The material may be a layered material having a plurality of layers adapted to include one or more of the above characteristics. While referred to as "layers," it is contemplated that this includes discrete layers or portions within one or more materials. For example, a two layer material may include two discrete layers or a single material having two different portions. The material may include one or more fibrous layers. The fibers may be arranged in a generally vertical orientation (e.g., in the thickness direction) when in an uncompressed state. The fibrous layers may include a carded and lapped material. When carded, the fibers may be arranged generally in the machine direction. When lapped, the fibers may be arranged to generally follow a generally sinusoidal shape. The fibers may be generally vertical (e.g., extending between surfaces in the thickness direction) between loops of the lapped structure. The fibers may be generally curved at the looped portions. The material may include one or more additional layers. One or more of the additional layers may be moisture wicking layers. For example, the layered material may include a moisture transport layer (e.g., a layer that contacts the source of moisture). The one or more additional layers may include one or more outer layers on an opposing surface of the one or more fibrous layers. The outer layer may be a wicking material. One or more of the layers, or the entire material itself, may be flexible, stretchable, breathable, or a combination thereof.

The layered product may have a shape that is able to be positioned or installed within an article of headwear, such as a helmet. The layered product may have a shape that allows the product to be worn on or around at least a portion of the wearer's head. The layered product may be a standalone article (e.g., worn without any additional headwear). The layered article may be integrated into the structure of the article of headwear, such as a helmet. The layered article may be attachable into the article of headwear. For example, the layered article may be removably attachable (e.g., via hook and loop fastener, clips, snaps, or the like). The layered article may be unattached to the article of headwear but able to be used in conjunction with the article of headwear. For example, the article may be secured around the user's head or may be positioned between the user's head and the article of headwear and held in place without fasteners, bands, straps, or the like.

The layered product may have any shape that allows the product to be used in its intended environment. The layered product may be formed as or include an elongated body. The elongated body may allow the layered product to be worn at or near a wearer's forehead. The layered product may provide more coverage to a user's head. For example, the layered product may be positioned within, secured to, or integrally formed with a helmet to provide coverage of a greater area of the head, such as the crown of the head, sides of the head, back of the head, or a combination thereof.

The layered material may be or may include a strip or elongated body. The elongated body may be defined by a first short edge and an opposing second short edge. The elongated body may be defined by a first long edge and a second long edge. The elongated body may be generally rectangular. The elongated body may have a generally constant length, width, or both. The length, width, or both, may be varied.

One or both of the short edges may be a generally straight edge (e.g., without curvature). One or both of the short edges may be at an angle relative to the longitudinal axis of the elongated body. One or both of the short edges may be generally perpendicular to the longitudinal axis of the elongated body. One or both of the short edges may be or may have a generally curved portion. For example, one or both of the short edges may have a rounded edge. One or both of the short edges may define the width of the material. For example, the short edge may have a length that is equal to the width of the elongated body, where the width of the body is measured from a point on the first long edge to an opposing point on the second long edge generally transverse to the longitudinal axis of the elongated body. One or both of the short edges may have a length that is different from the width of the body at its greatest point. For example, the short edges may have one length, and one or more of the long edges may have a curvature or angled portion to extend the width of the body. Such curvature may be independent of any ridges extending from the straight edge.

The width of the elongated body may be a sufficient width that the layered product can be installed within an article of headwear, such as a helmet. The width of the body may be such that, when installed within the headwear and worn on a user's head, the body portion is not visible. The elongated body may have a width that is able to be worn as a headband. For example, the elongated body may have a width that allows the material to be positioned on a wearer's forehead without extending into the wearer's line of vision. The elongated body may have sufficient width that it is able to be worn at or near a wearer's hairline. The elongated body may have a generally constant width. One or more sections of the elongated body may have a generally constant width. The elongated body may include one or more features that change the width of the layered product (e.g., one or more ridges or tabs). The elongated body may have a width of about 5 mm or more, about 10 mm or more, or about 20 mm or more. The elongated body may have a width of about 200 mm or less, about 150 mm or less, or about 50 mm or less.

The first and second long edges defining the elongated body may have one or more generally straight edges. The first long edge, the second long edge, or both, may be generally parallel to the longitudinal axis of the elongated body. The first long edge and the second long edge, or portions thereof, may be generally parallel to each other. The first long edge, the second long edge, or both, may include one or more curved features, one or more angled features, or both (e.g., one or more ridges or one or more tabs). The first long edge, the second long edge, or both, may include edge segments that are generally straight. These edge segments may, for example, extend from a short edge of the material to a ridge or tab extending from the elongated body.

The first long edge, the second long edge, or both, may extend between the first short edge and the second short edge to define the elongated body. The length of the elongated body may be measured from a point (e.g., a center point) at the first short edge to an opposing point at the second short edge. The length may be generally constant. The length may vary (e.g., depending on the shape of the short edges). The length of the elongated body may be sufficient such that the layered product can extend across at least a portion of a wearer's head. The length of the elongated body may be sufficient such that the layered product may extend across at least a portion of the forehead of a wearer. The length may be such that the product can extend at least from one temple to the other on a user's head. The product may extend from temple to temple across the forehead, over the head, or at any angle therebetween. The length may be such that the product can extend around about 10% or more, about 25% or more, about 50% or more, or about 100% or less of the circumference of the headwear item, such as a helmet. The length of the elongated body may be about 150 mm or more, about 250 mm or more, or about 300 mm or more. The length of the elongated body may be about 1000 mm or less, about 750 mm or less, or about 500 mm or less.

The layered material may include one or more portions extending from the body portion. An extended portion may modify the width of the layered material in one or more areas or sections. An extended portion may function to increase surface area of the layered material. An extended portion may function to guide and/or distribute moisture through the material. An extended portion may, for example, direct moisture toward an area of increased air flow (e.g., an air vent of the headwear within which it is installed). In guiding moisture toward the air vents, this may enhance and/or speed up evaporation of the moisture, at least in certain portions of the material. It is contemplated that at or near areas adjacent an air vent, the material may have a faster evaporation rate. The material, in that location, may be drier than other portions of the material. The material may then pull more moisture toward the drier areas, thereby increasing and expediting evaporation.

An extended portion of the layered material may include a projection or ridge extending from the first long edge of the material. The projection or ridge may function to provide additional surface area of the material to provide enhanced absorption, increased capacity for moisture, or both. The projection or ridge may function to direct moisture to an area where evaporation may more readily occur (e.g., at one or more vents or openings in the headwear, such as a helmet). The projection or ridge may be generally rounded or curved (e.g., having a semi-circular or semi-oval shape). The ridge or projection may have one or more straight edges. The ridge or projection may have one or more straight edges in combination with one or more rounded or curved portions. The projection or ridge may be located at a distance from the first short edge or second short edge. For example, a beginning of the ridge or projection (i.e., at the point where the ridge or projection extends from the body portion) may be about 25 mm or more, about 50 mm or more, or about 75 mm or more from the first short edge, the second short edge, or both. The projection or ridge may be generally centrally located along the first long edge. A plurality of projections or ridges may extend from the first long edge of the elongated body.

The projection or area of greater width than the length of the short edge may extend across the full length of the long edge. The projection may begin at a short edge, extending the width of the body portion, and transition to a generally straight edge in a generally centrally located portion along the length. For example, the elongated body may have a generally straight long edge on one side, and the opposing side may have one or more curves to extend the width of the generally elongated portion, where the curves begin at or near the short edge. Upon reaching a desired width, the edge may be generally straight before transitioning to another curved portion toward the opposing short edge.

The projection or ridge may be of a shape that is able to be received within the headwear, such as a helmet. The projection or ridge may be adapted to be positioned toward the crown of the head of the wearer. The projection or ridge may be positioned at or near one or more air vents of the headwear, such as a helmet. As the wearer perspires, the sweat may be wicked away via the interior wicking layer and distributed through the area of the layered material (e.g., the fibrous layer). The moisture may be directed toward the projection or ridge (e.g., via the fibrous layer and/or exterior wicking layer) at the vent or opening in the helmet, where it is exposed to air flow, thereby enhancing evaporation of the sweat. As evaporation of the moisture occurs at the ridge, more moisture is drawn to the ridge.

The projection or ridge may extend the width of the elongated body portion of the layered material. The width of the body portion and projection or ridge (e.g., at the widest point) may be about 20 mm or greater, about 30 mm or greater, about 50 mm or greater, or about 75 mm or greater. The width of the body portion and projection or ridge (e.g., at the widest point) may be about 500 mm or less, about 300 mm or less, or about 200 mm or less.

In applications where the layered material is not an elongated body, but rather a more full-coverage material, the layered material may still direct moisture toward areas of the material located at or near an air vent or near an area with air flow. It is contemplated that at or near areas adjacent an air vent, the material may have a faster evaporation rate. The material, in that location, may be drier than other portions of the material. The material may then pull more moisture toward the drier areas, thereby increasing and expediting evaporation.

For a material worn as a standalone item, it is possible that the areas exposed to the greatest air flow may dry faster or may exhibit a higher rate of evaporation than areas not exposed to as much air flow.

An extended portion of the layered material may include one or more tabs extending from the second long edge. When in use, the tabs may extend downwardly toward the wearer's face. The layered material may include two or more tabs. For example, the tabs may be positioned with one tab toward the first short edge and one tab toward the second short edge. The position of the tabs may correspond with the sides of the wearer's head when in use. For example, each tab may be generally positioned at the wearer's temples. The tabs may function to absorb perspiration at the sides of the wearer's head. The tabs may be adapted to contact the arms or band of eyewear (e.g., sunglasses, cycling glasses, goggles, glasses to enhance or improve vision). The tabs may be adapted to be located between the user's face and the arms or bands of glasses. The tabs may function to absorb and/or wick moisture away from the arms of the glasses. The tabs may function to remove moisture to prevent moisture from collecting or dripping toward the lenses of the glasses or toward the wearer's eyes.

The tabs may have any shape. One or more tabs may have one or more curved portions. One or more tabs may have one or more straight edges. One or more straight edges (e.g., at the end of the tab) may be generally angled in relation to the longitudinal axis of the elongated body portion when the material is flat. The angle of the straight edge may be such that when the layered material is curved or inserted into the headwear, such as a helmet, the edge is able to make line contact with or be flush with or complementary to the straight edge (and angle thereof) of an arm of eyewear, such as glasses.

The tabs may extend away from the body portion at a distance capable of performing the intended function. For example, the tab may have a length sufficient to contact the arm of a wearer's eyewear, such as glasses. The tab may have a length sufficient to be located between the wearer's face and eyewear (e.g., an arm of the eyewear). The tab may extend beyond the eyewear. The tab may be sufficiently long to wrap around the arm of the eyewear. The tab at its longest point, when measured from the second long edge may be about 10 mm or more, about 15 mm or more, or about 20 mm or more. The tab at its longest point may be about 50 mm or less, about 45 mm or less, or about 40 mm or less.

The tabs may begin at a short edge of the body portion. The tabs may begin at a distance from the edge of the body portion. The location of the tabs may depend upon the length of the body portion. For example, the tab may begin about 10 mm or more, about 15 mm or more, or about 20 mm or more from the closest short edge. The tab may begin about 100 mm or less, about 75 mm or less, or about 50 mm or less from the closest short edge.

The total thickness of the layered material may depend upon the number and thickness of the individual layers. The total thickness may be about 0.5 mm or more, about 1 mm or more, or about 1.5 mm or more. The total thickness may be about 30 mm or less, about 25 mm or less, or about 17 mm or less. Some of the individual layers may be thicker than other layers. For example, the thickness of the fibrous layers may be greater than the thickness of the wicking layers and/or outer layers (individually or combined). The total thickness of the fibrous layers may be greater than the total thickness of the wicking layers and/or outer layers. The thickness may vary between the same types of layers as well. For example, two fibrous layers in the layered material may have different thicknesses. The layered material may be tuned to provide desired characteristics and/or more general broad band moisture absorption/resistance by adjusting the specific air flow resistance and/or the thickness of any or all of the layers. The layers may all be coextensive.

The total thickness may vary across the layered material. The thickness may vary due to certain processing techniques, such as compression applied in certain areas. The thickness may decrease when approaching an edge of the material, particularly if the edges are sealed by a heat and/or compression technique. The thickness may vary due to the presence or lack of certain layers in some areas and not others. For example, there may be portions of the layered material where there are no fibrous interior layers. There may be portions where an inner layer, outer layer, or both, material is present without any fibrous material therebetween. The lack of a particular layer in an area of the layered material may provide flexibility of the material (e.g., to allow for proper fit within a helmet or on a head; to allow for folding or bending of the material), reduction of material (e.g., by positioning cushioning elements only where needed), increased comfort (e.g., by positioning cushioning elements only where needed or where sweat or moisture are most likely to be produced), or a combination thereof.

The layered material may be attached via a fastener, adhesive, or other material capable of securing the layered material to a substrate, or other surface, such as the interior of a helmet or other headwear. The securing of the layered material to itself or to another surface may be repositionable or permanent. The layered material may include one or more fasteners, adhesives, or other known materials for joining a layered material to a substrate, another portion of the layered material, another layered material, or a combination thereof. The fastener, adhesive, or other means of attachment may be able to withstand the elements to which it is exposed (e.g., temperature fluctuations). Fasteners may include, but are not limited to, screws, nails, pins, bolts, friction-fit fasteners, snaps, hook and eye fasteners, Velcro, zippers, clamps, the like, or a combination thereof. Adhesives may include any type of adhesive, such as a tape material, a peel-and-stick adhesive, a pressure sensitive adhesive, a hot melt adhesive, the like, or a combination thereof. The layered material may include one or more fasteners or adhesives to join portions of the layered material to another substrate. The layered material may include a pressure sensitive adhesive (PSA) to adhere the layered material to itself or to another surface.

The material of an outer layer of the layered product may be capable of being secured to a substrate, such as the interior of a helmet. The layered material may be secured yet removable and/or repositionable. For example, the fabric forming the outer layer may attach to a hook fastener material (e.g., part of a Velcro strip) secured to the substrate to which the layered material is to be located. The hook fastener material may sufficiently interact with the outer layer of the layered material such that a corresponding loop fastener is not necessary. For example, the interior of the headwear, such as a helmet, may include hook fastener buttons or strips. The layered material may be positioned against these hook fastener buttons or strips and held in place by the hooks interacting with the surface of the outer layer. It is also contemplated that the layered material may include part of a hook and loop fastener.

The layered material may be a pad or insert in an article of headwear, such as a helmet. The layered material may be positioned at least at the forward end of the headwear (e.g., where the wearer's face and/or forehead are located). It is contemplated that the layered material may be positioned to contact the wearer's forehead, sides of head, crown of head, back of head, or any combination thereof. The layered material may be positioned such that a projection, lobe, or ridge from the first long edge of the material extends toward the crown of the head and/or headwear. The layered material may be positioned such that the tabs extend downwardly, away from the headwear.

The layered material may cover about 5% or greater, about 10% or greater, about 25% or greater, or about 50% or greater of the interior surface of the article of headwear such as a helmet. The layered material may cover up to 100% of the interior surface of the article of headwear such as a helmet.

In a helmet such as a motorcycle or other motorsport helmet, the layered material may extend to cover parts of the face as well as the head. For example, the layered material may be positioned against a wearer's cheek, jaw, mouth, chin, or a combination thereof.

When installed within the headwear, the material may be located entirely within the confines of the headwear (e.g., so it is not visible when the headwear is worn). The material may have at least a portion that extends past the confines of the headwear (e.g., so it is visible when the headwear is worn). The material may be visible through vent holes or openings in the headwear.

One or both of the short edges of the layered material may be secured to a strap or may have a strap extending therefrom. The strap may, for example, be sewn to an edge of the layered material. The strap may be integrally formed with the layered material. One or both of the short edges may have a length that is generally equal to the width of a strap secured thereto or extending therefrom. The strap may allow the layered material to be secured around a wearer's head. The strap may allow the layered material to be otherwise secured (e.g., secured to a helmet or other headwear item). A single strap may join a first short end and a second short end (e.g., creating a continuous or ringlike structure or headband). Two or more straps may be used. For example, one strap may be secured to or extend from one short end, and another strap may be secured to or extend from the opposing short end. The two straps may be tied together or otherwise secured together using a fastener or fastening technique (e.g., one or more snaps, hook and loop fasteners). A loop or ring may be secured to one short end, and a strap may be secured to the opposing short end. The strap may be inserted through the loop and secured to hold the layered material in place (e.g., the strap may be inserted through the loop and folded over itself and secured via a fastening mechanism, such as a contact fastener or hook and loop fastener).

The strap may be an elastic strap. The strap may be formed of a material that is capable of stretching. The strap may be formed of a material that does not stretch, though it may be otherwise adjustable. The strap may be formed of a material that is the same as one or more layers of the layered material. The strap may be formed of a material that is different from one or more layers of the layered material. The strap may include an elastic strip disposed within a fabric sleeve. When the elastic strip is in a relaxed state, the sleeve may be generally bunched due to the fabric sleeve having a length greater than the length of the elastic strip in its relaxed state. When the elastic strip is in its stretched state, the sleeve may be less bunched or generally flat due to the difference in length between the fabric sleeve and elastic strip being smaller than when the elastic strip is in its relaxed state.

The layered material may have a designated interior layer (e.g., an interior wicking layer) adapted to contact the wearer's hair, scalp, forehead, head, face, or the like. The layered material may have a designated exterior layer (e.g., an exterior wicking layer) adapted to contact the headwear, face away from the wearer, be exposed to air flow, or a combination thereof. A fibrous layer may be located therebetween.

The layered material may include one or more fibrous layers. The fibrous layers may transfer moisture from one or more abutting layers. The fibrous layers may transfer moisture to one or more abutting layers. The fibrous layers may provide cushioning or protection. The fibrous layers may provide such cushioning or protection at a light weight.

One or more of the fibrous layers may have a high loft (or thickness) at least in part due to the orientation of the fibers (e.g., oriented generally transverse to the longitudinal axis of the layer) of the layer and/or the methods of forming the layer. The fibrous layer may exhibit good resilience and/or compression resistance. The fibrous layer may be resistant to puncturing. The fibrous layer, due to factors such as, but not limited to, unique fibers, surfaces, physical modifications to the three-dimensional structure (e.g., via processing), orientation of fibers, or a combination thereof, may exhibit good moisture transfer and/or absorption characteristics versus traditional materials.

The fibrous layer may be adjusted based on the desired properties. The fibrous layer may be tuned to provide a desired weight, thickness, compression resistance, or other physical attributes. The fibrous layer may be tuned to provide a desired moisture absorption or moisture transfer rate. The fibrous layer may be tuned to provide a desired drying rate. The fibrous layer may be formed from nonwoven fibers. The fibrous layer may be a nonwoven structure. The fibrous layer may be a lofted material. The fibrous layer may be thermoformable so that the layers may be molded or otherwise manufactured into a desired shape to meet one or more application requirements.

The fibrous layer may have a generally uniform distribution of fibers. The fibrous layer may have a generally uniform density throughout the thickness of the material. The fibrous layer may have a varying structure through the thickness. The fibrous layer may have a gradient structure where the material becomes more rigid or has a greater density. The change in density may be gradual. The gradient structure may be in the thickness direction. For example, the fibrous layer may have a softer interior surface (i.e., facing the skin of the wearer), and a harder external surface (i.e., facing away from the wearer) for attaching to the structure. The gradient structure may be across the length or width of the material. The gradient structure may further enhance moisture evaporation rate on the external side.

The fibrous layer may have a gradient structure where different portions of the fibrous layer absorb or hold different amounts of fluid or moisture. Different portions or areas may have different saturation points. For example, the fibrous layer may have a gradient structure in the thickness direction. Toward one surface of the fibrous layer, a greater volume of fluid may be absorbed and/or held within the material. In areas having a greater fluid capacity or a higher saturation point, additional fluid may be drawn to that area, thereby pulling the fluid or moisture away from the wearer, toward an area of increased evaporation, or both. For example, an area capable of containing or absorbing more fluid may be located at or near an area where there is increased air flow. The ability to draw more moisture to an area that also more quickly achieves evaporation may further improve the drying rate of the material. The gradient structure may occur within a single layer of material (e.g., as a result of fibers or other fillers used, the density of the material, processing techniques, the like, or a combination thereof). The gradient structure may occur through two or more layers arranged in generally planar contact to form the fluid containment layer.

The drying rate or rate of evaporation for the fibrous layer (or the layered material as a whole) may be improved over other products, such as foams or cross-lapped products. This may be due, at least in part, to factors such as shape, porosity, permeability, fiber orientation of the fibrous layer, orientation of the loops of the fibrous layer, or a combination thereof. The fibrous layer may have a high porosity, high percentage of open areas, high permeability, or combination thereof. This may allow for air to flow more efficiently through the material, as opposed to a more tortuous material such as a foam or cross-lapped material. The fibrous layer may have a porosity of about 90% or greater, about 96% or greater, about 97% or greater, or about 98% or greater or about 99% or greater. The porosity of the fibrous layer may be less than 100%.

The fibrous layer may be permeable. The fibrous layer may be porous. The fibrous layer may have pores. The pores may be formed from interstitial spaces between the fibers and/or the shape (e.g., by having a multi-lobal or deep-grooved cross-sectional fiber) of the fibers. The pores may extend throughout the entire thickness of the fibrous layer. The pores may extend through a portion of the thickness of the fibrous layer. The pores and/or the vertical orientation of the fibers may create a capillary effect or chimney effect for absorbing moisture or removing moisture from one surface and transferring to another area (e.g., to another moisture wicking layer, to another portion of the fibrous layer, and the like). For example, the fibrous layer may push and/or pull the moisture from a first surface of the fibrous layer to an opposing second surface of the fibrous layer through the thickness of the fibrous layer. Capillary effect, or capillary action, is the ascension of liquids through a tube, pore, cylinder, or permeable substance due to adhesive and cohesive forces interacting between the liquid and the surface. The diameter of the pores or channels defined by the fibers (e.g., forming a capillary) for movement of liquid may be selected based on the thickness of the material through which the liquid must travel. A thinner diameter capillary or channel may see the liquid rise higher than liquid in a larger diameter capillary or channel due to capillary action because of adhesive forces.

The ability of the fibrous layer to pull or push moisture through the layer may be, at least in part, due to the geometries of the fibers. The fibers may have a cross-section that is substantially circular or rounded. The fibers may have a cross-section that has one or more curved portions. The fibers may have a cross-section that is generally oval or elliptical. The fibers may have a cross-section that is non-circular. Such non-circular cross-sections may create additional tubes or capillaries within which the moisture can be transferred. For example, the fibers may have geometries with a multi-lobal cross-section (e.g., having 3 lobes or more, having 4 lobes or more, or having 10 lobes or more). The fibers may have a cross-section with deep grooves. The fibers may have a substantially "Y"-shaped cross-section. The fibers may have a polygonal cross-section (e.g., triangular, square, rectangular, hexagonal, and the like). The fibers may have a star shaped cross-section. The fibers may be serrated. The fibers may have one or more branched structures extending therefrom. The fibers may be fibrillated. The fibers may have a cross-section that is a nonuniform shape, kidney bean shape, dog bone shape, freeform shape, organic shape, amorphous shape, or a combination thereof. The fibers may be substantially straight or linear, hooked, bent, irregularly shaped (e.g., no uniform shape), or a combination thereof. The fibers may include one or more voids extending through a length or thickness of the fibers. The fibers may have a substantially hollow shape. The fibers may be generally solid. The shape of the fibers may define capillaries or channels through which moisture can travel (e.g., from one side of the fibrous layer to an opposing side of the fibrous layer).

The movement of the moisture within the fibrous layer is not limited to vertical movement in the thickness direction. Moisture may move at any angle relative to the thickness direction. Moisture may move at any angle relative to the longitudinal axis of the material along the length or width of the material. Due to the porous structure of the fibrous layer, moisture may move over, up, or both. Moisture may travel to areas of less moisture (e.g., toward areas at or near an air vent of a helmet). Moisture may travel along fibers. Therefore, particular orientations of fibers may aid in the transfer and/or evaporation of moisture. In a lapped structure, such as a vertically lapped structure, moisture may travel across loops (e.g., via fibers therebetween), between opposing loops (e.g., from a lower loop to an upper loop), or both.

The fibers that make up the fibrous layers (or any other layer of the material) may have an average linear mass density of about 0.5 denier or greater, about 1 denier or greater, or about 5 denier or greater. The material fibers that make up the fibrous layers may have an average linear mass density of about 25 denier or less, about 20 denier or less, or about 15 denier or less. Fibers may be chosen based on considerations such as cost, resiliency, desired moisture absorption/resistance, or the like. For example, a coarser blend of fibers (e.g., a blend of fibers having an average denier of about 12 denier) may help provide resiliency to the fibrous layers. A finer blend (e.g., having a denier of about 10 denier or less or about 5 denier or less) may be used, for example, if a softer material is required to contact a user's skin. The fibers may have a staple length of about 1.5 millimeters or greater, or even about 70 millimeters or greater (e.g., for carded fibrous webs). For example, the length of the fibers may be between about 30 millimeters and about 65 millimeters. The fibers may have an average or common length of about 50 to 60 millimeters staple length, or any length typical of those used in fiber carding processes. Short fibers may be used (e.g., alone or in combination with other fibers) in any nonwoven processes. For example, some or all of the fibers may be a powder-like consistency (e.g., with a fiber length of about 3 millimeters or less, about 2 millimeters or less, or even smaller, such as about 200 microns or greater or about 500 microns or greater). Fibers of differing lengths may be combined to provide desired properties. The fiber length may vary depending on the application; the moisture properties desired; the type, dimensions and/or properties of the fibrous material (e.g., density, porosity, desired air flow resistance, thickness, size, shape, and the like of the fibrous layer and/or any other layers of the layered material); or any combination thereof. The addition of shorter fibers, alone or in combination with longer fibers, may provide for more effective packing of the fibers, which may allow pore size to be more readily controlled in order to achieve desirable characteristics (e.g., moisture interaction characteristics).

The fibrous layer (or any other layer of the material) may include fibers blended with the inorganic fibers. The fibrous layer may include natural, manufactured, or synthetic fibers. Suitable natural fibers may include cotton, jute, wool, flax, silk, cellulose, glass, and ceramic fibers. The fibrous layer may include eco-fibers, such as bamboo fibers or *eucalyptus* fibers. Suitable manufactured fibers may include those formed from cellulose or protein. Suitable synthetic fibers may include polyester, polypropylene, polyethylene, Nylon, aramid, imide, acrylate fibers, or combination thereof. The fibrous layer material may comprise polyester fibers, such as polybutylene terephthalate (PBT), polyethylene terephthalate (PET), polytrimethylene terephthalate (PTT), and co-polyester/polyester (CoPET/PET) adhesive bi-component fibers. The fibers may include polyacrylonitrile (PAN), oxidized polyacrylonitrile (Ox-PAN, OPAN, or PANOX), olefin, polyamide, polyetherketone (PEK), polyetheretherketone (PEEK), polyethersulfone (PES), or other polymeric fibers. The fibers may be selected for their melting and/or softening temperatures. The fibers may include mineral or ceramic fibers. The fibers may be or may include elastomeric fibers. Elastomeric fibers may provide cushioning performance and/or compressibility and recovery properties. Exemplary elastomeric fibers include elastic bicomponent PET, PBT, PTT, or a combination thereof. The fibers may be formed of any material that is capable of being carded and lapped into a three-dimensional structure. The fibers may be 100% virgin fibers, or may contain fibers regenerated from postconsumer waste (for example, up to about 90% fibers regenerated from postconsumer waste or even up to 100% fibers regenerated from postconsumer waste). The fibers may have or may provide improved moisture absorption or moisture resistance characteristics, or both.

The fibers may have particles embedded therein. The particles may act to remove moisture in the vapor stage (e.g., before becoming liquid). The particles may be embedded through an extrusion process. These particles may provide breathability and/or waterproofing properties to the fibrous layer. The particles present in the fibers may increase the surface area of the fiber by 50% or more, about 100% or more, by 200% or more, or by 500% or more as compared with a fiber that is free of embedded particles. The particles may increase the surface area of the fiber by about 1200% or less, about 1000% or less, or about 900% or less. The high surface area of the fiber may provide high adsorption properties. These fibers may assist in providing heating and/or cooling. These fibers may provide odor control, humidity control (e.g., body humidity control), or both. The particles may assist in removing or driving moisture vapor away from the source (e.g., through the layer). Embedded particles may include, but are not limited to, wood, shells (e.g., fruit and/or nut shells, such as coconut shells or fibers thereon, hazelnut shells), activated carbon, sand (e.g., volcanic sand), or a combination thereof. For example, the fiber may be a PET fiber extruded with active carbon and/or volcanic sand.

The fibers may be 100% virgin fibers or less. The fibers may include fibers regenerated from postconsumer waste (for example, up to about 90% fibers regenerated from postconsumer waste or even up to 100% fibers regenerated from postconsumer waste). The fibers may have or may provide improved thermal insulation properties. The fibers may have relatively low thermal conductivity. Such fibers may be useful for retaining heat or slowing the rate of heat transfer (e.g., to keep a user or wearer warm). The fibers may have or may provide high thermal conductivity, thereby increasing the rate of heat transfer. Such fibers may be useful for extracting heat from the surface of the source of moisture (e.g., to cool a user or wearer). The fibers may have geometries that are non-circular or non-cylindrical. The fibrous layer may include or contain engineered aerogel structures to impart additional thermal insulating benefits. The fibrous layer may include or be enriched with pyrolized organic bamboo additives.

The fibers, or at least a portion of the fibers, making up one or more layers of the material may include a hydrophilic finish or coating. The hydrophilic finish or coating may create or improve the capillary effect of drawing the moisture into the capillaries or channels formed by the fibers or improve absorption of the material by drawing the moisture away from the user. The fibers, or at least a portion of the fibers, may be super absorbing fibers (SAF). The SAF may be formed of a cellulose material or a synthetic polymeric material, for example. The SAF may be in a blend with other fibers. The SAF may be present in an amount of about 60% of the blend by weight or less, about 50% by weight or less, or about 40% by weight or less. The SAF may be present in an amount greater than 0%, about 1% by weight or greater, or about 5% by weight or greater. The SAF may pull moisture into the material cross-section, where it may evaporate.

One or more fibrous layers (or any other layer of the material) may include a plurality of bi-component fibers. The bi-component fibers may be a thermoplastic lower melt bi-component fiber. The bi-component fibers may have a lower melting temperature than the other fibers within the mixture (e.g., a lower melting temperature than common or staple fibers). The bi-component fibers may be air laid or mechanically carded, lapped, and fused in space as a network so that the layered material may have structure and body and can be handled, laminated, fabricated, installed as a cut or molded part, or the like to provide desired properties. The bi-component fibers may include a core material and a sheath material around the core material. The sheath material may have a lower melting point than the core material. The web of fibrous material may be formed, at least in part, by heating the material to a temperature to soften the sheath material of at least some of the bi-component fibers.

The fibrous layer (or any other layer of the layered material) may include a binder or binder fibers. Binder may be present in the fibrous layer in an amount of about 100 percent by weight or less, about 80 percent by weight or less, about 60 percent by weight or less, about 50 percent by weight or less, about 40 percent by weight or less, about 30 percent by weight or less, about 25 percent by weight or less, or about 15 percent by weight or less. The fibrous layer may be substantially free of binder. The fibrous layer may be entirely free of binder. While referred to herein as fibers, it is also contemplated that the binder could be generally powder-like, spherical, or any shape capable of being received within interstitial spaces between other fibers and capable of binding the fibrous layer together. The binder may have a softening and/or melting temperature of about 70° C. or greater, about 100° C. or greater, about 110° C. or greater, about 130° C. or greater, 180° C. or greater, about 200° C. or greater, about 225° C. or greater, about 230° C. or greater, or even about 250° C. or greater. For example, the binder may have a softening and/or melting temperature between about 70° C. and about 250° C. (with any range therein being contemplated). The fibers may be high-temperature thermoplastic materials. The fibers may include one or more of polyamideimide (PAI); high-performance polyamide (HPPA), such as Nylons; polyimide (PI); polyketone; polysulfone derivatives; polycyclohexane dimethyl-terephthalate (PCT); fluoropolymers; polyetherimide (PEI); polybenzimidazole (PBI); polyethylene terephthalate (PET); polybutylene terephthalate (PBT); polyphenylene sulfide; syndiotactic polystyrene; polyetherether ketone (PEEK); polyphenylene sulfide (PPS), polyether imide (PEI); and the like. The fibrous layer may include polyacrylate and/or epoxy (e.g., thermoset and/or thermoplastic type) fibers. The fibrous layer may include a multi-binder system. The fibrous layer may include one or more elastomeric fiber materials acting as a binder. The fibrous layer may include one or more sacrificial binder materials and/or binder materials having a lower melting temperature than other fibers within the layer.

The fibers and binders discussed herein in the context of the fibrous layers may also be used to form any other layer of the layered material.

The fibers forming the one or more fibrous layers may be formed into a nonwoven web using nonwoven processes including, for example, blending fibers, carding, lapping, air laying, mechanical formation, or a combination thereof. Through these processes, the fibers may be oriented in a generally vertical direction or near-vertical direction (e.g., in a direction generally perpendicular to the longitudinal axis of the fibrous layer). The fibers may be opened and blended using conventional processes. The resulting structure formed may be a lofted fibrous layer. The lofted fibrous layer may be engineered for optimum weight, thickness, physical attributes, thermal conductivity, insulation properties, moisture absorption, or a combination thereof.

One or more fibrous layers may be formed, at least in part, through a carding process. The carding process may separate tufts of material into individual fibers. During the carding process, the fibers may be aligned in substantially parallel orientation with each other and a carding machine may be used to produce the web. The fibers may extend generally in or generally parallel to the machine direction.

A carded web may undergo a lapping process to produce the fibrous layers. The carded web may be rotary lapped, cross-lapped or vertically lapped, to form a voluminous or lofted nonwoven material. The carded web may be vertically lapped according to processes such as "Struto" or "V-Lap", for example. This construction provides a web with relative high structural integrity in the direction of the thickness of the fibrous layers, thereby minimizing the probability of the web falling apart during application, or in use, and/or providing compression resistance to the layered material. Carding and lapping processes may create nonwoven fibrous layers that have good compression resistance through the vertical cross-section (e.g., through the thickness of the layered material) and may enable the production of lower mass fibrous layers, especially with lofting to a higher thickness without adding significant amounts of fiber to the matrix. It is contemplated that a small amount of hollow conjugate fiber (i.e., in a small percentage) may improve lofting capability and resiliency to improve moisture absorption, physical integrity, or both. Such an arrangement also provides the ability to achieve a low density web with a relatively low bulk density.

The lapping process may create a looped, sinusoidal, or undulated appearance of the fibers when viewed from its cross-section prior to any compression operation. The loops may have generally curved or rounded portions (e.g., as opposed to sharp creases from a traditional pleating operation). The frequency of the loops or undulations may be varied during the lapping process. For example, having an increase in loops or undulations per area may increase the density and/or stiffness of the layer or layers of the material. Reducing the loops or undulations per area may increase the flexibility of the layer or layers and/or may decrease the density. The ability to vary the loop or undulation frequency during the lapping process may allow for properties of the material to be varied or controlled. It is contemplated that the loop or undulation frequency may be varied throughout the material. During the lapping process, the loop frequency may be dynamically controlled and/or adjusted. The adjustment may be made during the lapping of a layer of the material. For example, certain portions of the layer may have an increased frequency, while other portions of the layer or layers may have a frequency that is lower. The adjustment may be made during the lapping of different layers of the material. Different layers may be made to have different properties with different loop frequencies. For example, one layer may have a loop frequency that is greater than or less than another layer of the layered material.

In an exemplary fibrous layer, the carded web, with the fibers generally extending in the machine direction, may then undergo a lapping process, creating a series of loops or undulations (e.g., appearing as peaks and valleys when viewed from the side or a cross section). The loops (e.g., line extending across an entire peak or valley) may extend across the surface of the material generally perpendicularly to the longitudinal axis of the fibrous layers, generally perpendicularly to the machine direction, or both. For example, when positioned across a wearer's forehead, the loops may run up and down the wearer's forehead rather than across the wearer's forehead.

In another exemplary fibrous layer, it is contemplated that the loops (e.g., line extending across an entire peak or valley) may extend generally parallel to the longitudinal axis of the fibrous layers. For example, when positioned across a wearer's forehead, the loops may run across the wearer's forehead.

The fibrous layers may be formed by an air laying process. This air laying process may be employed instead of carding and/or lapping. In an air laying process, fibers are dispersed into a fast moving air stream, and the fibers are then deposited from a suspended state onto a perforated screen to form a web. The deposition of the fibers may be performed by means of pressure or vacuum, for example. An air laid or mechanically formed web may be produced. The web may then be thermally bonded, air bonded, mechanically consolidated, the like, or combination thereof, to form a cohesive nonwoven fibrous layer. While air laying processes may provide a generally random orientation of fibers, there may be some fibers having an orientation that is generally in the vertical direction so that resiliency in the thickness direction of the material may be achieved.

During processing of the material, the fibrous layers may be compressed. Compression may occur during lamination, thermoforming in-situ, or the like. Compression may reduce thickness of the fibrous layers. The thickness may be reduced by 30% or more, about 40% or more, about 50% or more, or about 55% or more. The thickness may be reduced by about 80% or less, about 75% or less, about 67% or less, or about 60% or less. For example, a fibrous layer prior to compression may be about 15 mm to about 18 mm thick. After compression, the fibrous layer may be about 9 mm to about 10 mm. Upon compression, instead of a generally sinusoidal cross-section with generally straight segments between opposing loops, the segments between the loops may be generally C-shaped, S-shaped, Z-shaped, or otherwise curved, folded, or bent.

The layered material may include one or more acquisition layers, which may function to draw moisture from the source, from a layer directly adjacent, or both. The acquisition may be a facing layer. The acquisition layer may be an outer layer. The acquisition layer may be a wicking layer. The acquisition layer may be formed using any of the fibers and/or binders discussed herein with respect to the fibrous layer. One or more acquisition layers may be made, for example, from Lycra, polyester, polyethylene terephthalate, or a combination thereof.

An acquisition layer may include one or more moisture transport layers, which may serve to transport moisture from a source (e.g., a wearer's head, forehead, or face; a layer directly adjacent) to the one or more fibrous layers. The one or more moisture transport layers may draw moisture from the source and distribute the moisture over a wider surface area to enhance absorption by other layers, to enhance evaporation or drying of the moisture, or both. One layer may serve as an acquisition layer, which may function to draw moisture from the source. Another layer may serve as a distribution layer, which may function to disperse moisture around the area of the layer and/or adjacent layers. These functions may instead be performed by a single layer.

The one or more moisture transport layers may be attached to one side of a fibrous layer. The one or more moisture transport layers may be adapted to abut or contact a surface that is the source of the moisture. For example, a moisture transport layer may be a contact surface for a person's skin. The moisture transport layer may facilitate movement of sweat or moisture from skin to the fibrous layer. The moisture transport layer may have a smooth-to-the-touch surface to provide a comfortable contact surface.

The layered material may include one or more wicking layers. One or more of the wicking layers may be a facing or outer layer. The wicking layers may be located within the layered material. The wicking layers may be formed from a nonwoven material, a woven material, a knit material, a meltblown material (e.g., of thermoplastic polyurethane), or the like. A wicking layer may include or may be one or more moisture transport layers, which may serve to transport the moisture from the source (e.g., skin or another moist layer, such as a garment) to the one or more fibrous layers. A wicking layer may draw moisture from the source and distribute the moisture over a wider surface area to enhance absorption by other layers, to enhance evaporation or drying of the moisture, or both. The wicking layers of the layered material may be the same or they may be different. One or more of the layers may draw moisture in vapor form away from the source. For example, one or more layers may pull perspiration vapor away from a body before the perspiration becomes liquid sweat. The wicking layers may be formed using any of the fibers and/or binders discussed herein with respect to the fibrous layer. One or more wicking layers may be made from Lycra, polyester, polyethylene terephthalate, or a combination thereof.

It is further contemplated that one or more of the layers may be a non-wicking material formed by any of the fibers and/or binders discussed herein with respect to the fibrous layer. One or more of the wicking layers may be substituted by a non-wicking layer, such as a scrim, facing, mesh, or other permeable material.

The layered material may include one or more facing layers. The one or more facing layers may be an outer layer (e.g., an outermost layer of the material). The facing and/or outer layer may be an acquisition layer. An outer layer may face the surface of the source of the moisture. An outer layer may face away from the surface of the source of the moisture. Outer layers may be located on opposing sides of the fibrous layers and/or on opposing sides of the entire layered material. An outer layer may act to take up moisture from the source of the moisture or take up moisture from a layer directly adjacent. One or more of the facing or outer layers may encourage evaporation or have quick drying properties. One or more of the layers may draw moisture in vapor form away from the source. For example, one or more layers may pull perspiration vapor away from a body before the perspiration becomes liquid sweat. The one or more outer layers may be permeable or breathable to allow for air flow within the layer. The breathability or permeability may enhance the evaporation of the moisture, thereby allowing the layered material to dry. The outer layer may include perforations, apertures, voids, or openings to further encourage permeability and/or drying of the layer.

The outer layer may include one or more features for securing the layered material within a helmet or other headwear item. For example, the outer layer may include a portion of a hook or loop fastener for engaging with the opposite hook or loop fastener within the helmet or other headwear item. The outer layer may be formed of a material that has a frictional surface, at least in some areas, to prevent or reduce sliding of the layered material. The outer layer may be formed of a material, at least partially, that engages with a hook fastener (without requiring a corresponding loop fastener).

The facing or outer layer that faces away from the wearer may provide drag reduction. The facing or outer layer may be formed of a drag-resistant material that allows the majority of air flow to move freely (i.e., low turbulence) through the helmet (e.g., if air vents are present within the helmet). The facing or outer layer may still capture sufficient air flow to balance other functions of the layered material, such as cooling, moisture evaporation, and insulation. This may provide considerable improvements over existing traditional polyurethane foam materials used in headwear such as helmets, as polyurethane foams have poor or no air flow or moisture management characteristics. The facing or outer layer may have one or more features for reducing drag. This may be inherent in the material itself. This may be a result of an added feature or coating. For example, the facing or outer layer may have a fabric design, print, or three-dimensional knit that helps guide air flow or helps improve or reduce drag for the material that faces the helmet side. It is contemplated that the material may include a printing or knit or weave that provides ridges, channels, or patterns, that provide a three-dimensional fabric that is tubular in the direction of the air flow.

One or more fibrous layers, the fibers forming the fibrous layers, the resulting layered material, or a combination thereof, may be used to form a thermoformable layered material (which may be nonwoven), which indicates a material (e.g., nonwoven material) that may be formed with a broad range of densities and thicknesses and that contains a thermoplastic and/or thermoset binder. The thermoformable material may be heated and thermoformed into a specifically shaped thermoformed product. The layered material may have a varying thickness (and therefore a varied or non-planar profile) along the length of the material. Areas of lesser thickness may be adapted to provide controlled flexibility to the material, such as to provide an area with additional flexibility and elasticity, such as to form a stretchable compression article of clothing. The layered material may be shaped (e.g., by folding, bending, thermoforming, molding, and the like) to produce a shape generally matching a desired shape for a given application.

The layered material may be formed of a plurality of layers, including one or more wicking layers, (e.g., one or more moisture transport layers, one or more outer layers), one or more surface layers, one or more skin layers, and/or one or more fibrous layers, in any combination and in any order. The material may include two or more fibrous layers. The layered material may include one or more lofted layers, one or more wicking layers, or both. A skin layer may be formed by melting a portion of the layer by applying heat in such a way that only a portion of the layer, such as the top surface, melts and then hardens to form a generally smooth surface. A scrim may be applied or secured to one or more fibrous layers. The layered material may include a plurality of layers, some or all of which serve different functions or provide different properties to the layered material. The ability to combine layers having different properties may allow the layered material to be customized based on the application. For example, the layers may be combined so that the layered material is an article of clothing or padding that is moisture wicking, moisture transferring, insulative, cooling, has low drying times, or a combination thereof. The layers may be combined so that the layered material provides cushioning with high resilience.

A coating may be applied to form one or more surface layers on the fibrous layers. The coating may improve one or more characteristics of the layered material. For example, the surface layers may be anti-microbial, anti-fungal, have high infrared reflectance, moisture resistant, mildew resistant, or a combination thereof. The surface layers may be an extension of the fibrous layers or wicking layers. At least some of the surface layers may be metalized. For example, fibers along an outer surface of the fibrous layers or wicking layers may form the surface layers. Metallization processes can be performed by depositing metal atoms onto the fibers of the surface layers. As an example, metallization may be established by applying a layer of silver atoms to the surface layers. Metalizing may be performed prior to the application of any additional layers to the fibrous layers.

The metallization may provide a desired reflectivity or emissivity. The surface layers may be about 50% IR reflective or more, about 65% IR reflective or more, or about 80% IR reflective or more. The surface layers may be about 100% IR reflective or less, about 99% IR reflective or less, or about 98% IR reflective or less. For example, the emissivity range may be about 0.01 or more or about 0.20 or less, or 99% to about 80% IR reflective, respectively. Emissivity may change over time as oil, dirt, degradation, and the like may impact the fibers in the application.

Other coatings may be applied to the fibrous layers to form the surface layers, metallized or not, to achieve desired properties. Oleophobic and/or hydrophobic treatments may be added. Flame retardants may be added. A corrosion resistant coating may be applied to the metalized fibers to reduce or protect the metal (e.g., aluminum) from oxidizing and/or losing reflectivity. IR reflective coatings not based on metallization technology may be added. Anti-microbial or anti-fungal coatings may be applied. For example, silver powder or other antimicrobial nano-powders can be added into a portion of the fibrous layers to form the surface layers.

One or more layers may be a porous bulk absorber (e.g., a lofted porous bulk absorber formed by a carding and/or lapping process). One or more layers may be formed by air laying. The layered material may be formed into a generally flat sheet. The layered material (e.g., as a sheet) may be capable of being rolled into a roll. The layered material may be a continuous material so that longer lengths can be employed in a single piece. The layered material (or one or more of the layers of the layered material) may be an engineered 3D structure. It is clear from these potential layers that there is great flexibility in creating a material that meets the specific needs of an end user, customer, installer, and the like.

The fibrous layers, the wicking layers, the surface layers, or a combination thereof may be directly attached to one another. One or more layers may be attached to each other by a laminating process. The one or more layers may then be supplied as a roll or a sheet of the laminated product. The one or more layers, therefore, may be attached to each other prior to any additional shaping or molding steps. The one or more layers may include a thermoplastic component (e.g., binder or fibers) that melt and bond to an adjacent surface upon exposure to heat. One or more layers may be attached to each other with an adhesive layer. The layers forming a layered material may be attached to an additional layered material. For example, a first layered material may be directly attached to a second layered material (e.g., by one or more adhesive layers) to form a layered material assembly. The layered material assembly may include more than two layered materials. The adhesive layer may be an adhesive. The adhesive may be a powder or may be applied in strips, sheets, or as a liquid or paste. The adhesive layer may extend along a surface of the fibrous layers, the wicking layers, the surface layers, or a combination thereof, to substantially cover the surface. The adhesive layer may be applied to a portion of the surface of the fibrous layers, the wicking layers, the surface layers, or a combination thereof. The adhesive layer may be applied in a pattern (e.g., dots of adhesive applied to the surface). The adhesive layer may be applied in a uniform thickness. The adhesive layer may have varying thickness. The adhesive layer may be a single layer (e.g., a single adhesive). The adhesive layer may be multiple layers (e.g., an adhesive layer and a thermoplastic fiber layer). The adhesive layer may be a single layer of blended materials (e.g., an adhesive and thermoplastic fibers are blended in a single layer).

The layers may be directly attached to each other via other processes, such as by sewing, entanglement of fibers between layers, sealing, or other methods. The edges of the layers may be sewn together. One or more layers may be sealed at the edges. For example, the outer layers (e.g., the wicking layers) may be sealed at the edges to encapsulate the interior layers, such as one or more fibrous layers. The layers may be heated and/or compressed to seal all of the layers together. For example, heated pinch edge sealing may bond the layers together. A double die system may be used, where the central portion of each die is insulated so as not to burn or melt the body of the material, and the edges of the dies are heated and pinched together such that the edges are sealed and the body of the material remains lofted. The thickness at this pinched edge may be about 3 mm or less, about 2 mm or less, or about 1 mm or less and greater than 0 mm. One or more layers or one or more edges may be ultrasonically sealed. The edge may be trimmed or cut after heating, compressing, pinching, sealing, the like, or combination thereof.

One of more of the layers of the layered material may have hydrophobic properties. One or more of the layers of the layered material may have hydrophilic properties. Entire layers may be hydrophobic or hydrophilic. A layer may have both hydrophobic and hydrophilic properties. For example, a layer may be formed from a mixture of hydrophobic fibers and hydrophilic fibers. The interfaces between layers may include one hydrophobic layer or portion abutting a hydrophilic layer or portion. The layer contacting the source of the moisture may be hydrophilic. Such layer may cause moisture to wick away from the skin and distribute the moisture over a larger area to quicken the wicking. Adjacent layers may, for example, be hydrophobic. This may assist in the drying of the material and/or resisting the uptake of moisture from the external environment. It is also possible that a hydrophobic layer or portions thereof may function to draw moisture away from a surface (e.g., a user's skin) while absorbing little to no moisture, thereby acting to wick away the moisture. The hydrophobic layers or portions thereof may function to transfer moisture to another layer of the layered material. The hydrophilic layers or portions thereof may function to absorb moisture (e.g., from one or more hydrophobic layers or portions). Fibers within the layers may be hydrophobic. Fibers within the layers may be hydrophilic.

Fibers of one or more layers of the layered material, or one or more layers of the layered material, may exhibit antimicrobial properties. The fibers may be treated with an antimicrobial substance. For example, silver or copper may be used. Fibers may be coated with silver, copper, or a combination thereof. The antimicrobial substance may be otherwise deposited on the surface of the fibers (e.g., via sputtering, electrostatic deposition). The antimicrobial substance may be part of the fibers. For example, silver particles, copper particles, or both, may be within fibers of the one or more layers of the layered material.

The layered material disclosed exhibits breathability, which allows for an increased drying time of the material and/or increased cooling of the surface of the source of the moisture. With the ability for air to permeate the material, this decreases the drying time, thereby also decreasing the formation of mold, mildew, and/or odors. The layered material, or one or more layers thereof, may exhibit a permeability at 100 Pa of about 600 liters per square meter per second ($L/m^2/s$) or greater, about 700 $L/m^2/s$ or greater, or about 800 $L/m^2/s$ or greater. The layered material, or one or more layers thereof, may exhibit a permeability of about 1500 $L/m^2/s$ or less, about 1200 $L/m^2/s$ or less, or about 1000 $L/m^2/s$ or less. This is a significant improvement over other traditional materials. For example, a polyurethane memory foam at 1100 $g/m^2$ at 15 mm thickness exhibits a permeability of about 500 $L/m^2/s$. An open cell polyurethane foam material at 600 $g/m^2$ at 20 mm thickness exhibits a permeability of less than about 100 $L/m^2/s$. A two-layered foam formed of an ethylene vinyl acetate foam layer at 10 mm thickness and polyurethane foam layer 2 mm thickness at 1100 $g/m^2$ total exhibits no permeability.

The layered material may provide cushioning while also providing moisture wicking, evaporation, thermal insulation, or the like. The layered material, or layers thereof, may exhibit resilience. Resilience may be at least in part due to the orientation of the fibers, geometry of the fibers, denier of the fibers, composition of the fibers, the like, or a combination thereof. Resilience may be measured using a standardized compression force deflection or indentation force deflection test (e.g., ASTM D3574). The desired resilience may depend upon the application within which the layered material is used. The layered material may have a resilience suitable for its intended purpose.

The layered material or one or more layers thereof (e.g., fibrous layer) may be formed to have a thickness and density selected according to the required physical, insulation, moisture absorption/resistance, and air permeability properties desired of the finished layers (and/or the layered material as a whole). The layers of the layered material may be any thickness depending on the application, location of installation, shape, fibers used, fiber geometry and/or orientation, lofting of the fibrous layers, or other factors. The density of the layers may depend, in part, on the specific gravity of any additives incorporated into the material comprising the layer (such as nonwoven material), and/or the proportion of the final material that the additives constitute. The layered material may have a varying density and/or thickness along one or more of its dimensions. Bulk density generally is a function of the specific gravity of the fibers and the porosity of the material produced from the fibers, which can be considered to represent the packing density of the fibers.

The layered material may be formed through one or more lamination techniques, or another technique capable of joining two or more layers together. The one or more layers may then be supplied as a roll or a sheet of the laminated product. The one or more layers, therefore, may be attached to each other prior to any additional shaping or molding steps.

Moisture absorption, moisture resistance, insulation, or a combination thereof of the layered material (and/or its layers) may be impacted by the shape of the layered material. The layered material, or one or more of its layers, may be generally flat. The layered material, or one of its layers, may be supplied as a sheet. The layered material or one or more of its layers may be supplied in a roll. One or more layers of the layered material may be laminated together (e.g., to supply the layered material as a sheet or roll and/or prior to any additional shaping or molding step). The finished layered material may be fabricated into cut-to-print two-dimensional flat parts depending on the desired application. The layered material may be formed into any shape. For example, the layered material may be molded (e.g., into a three-dimensional shape) to generally match a desired shape. The finished layered material may be molded-to-print into a three-dimensional shape for a desired application.

Through and between any of the layers, moisture may travel in any direction. Moisture may move vertically in the thickness direction. Moisture may move in the length and/or width direction. Moisture may travel at any angle between vertical and horizontal, relative to the thickness direction. Moisture may travel at any angle between the length direction and the width direction relative to the longitudinal axis of the layered material. Moisture may travel to areas having less moisture present (e.g., areas at or near an area of air flow). Moisture may travel toward an air vent in a helmet. Moisture may travel generally linearly. Moisture may travel in a non-linear direction or in multiple directions.

Moisture may travel across and/or along the fibers of one or more fibrous layers. Moisture may travel in the direction of the fibers. Moisture may travel in the thickness direction in areas between loops of the lapped structure. Moisture may travel in the generally longitudinal direction at areas of loops of the lapped structure. Moisture may travel across loops (e.g., from one loop to an adjacent loop via fibers extending between the two).

The fibrous layer, entire layered material, or both, may have a Sweat Management Index value. The Sweat Management Index (SMI) is calculated by adding the holding capacity and the drying rate for 1 hour. The calculations may be obtained in the manner as described in the Illustrative Examples section of the present application. The higher the SMI, the better. The fibrous layer, entire layered material, or both, may have a Sweat Management Index of about 40 or greater, about 50 or greater, or about 55 or greater. The fibrous layer, entire layered material, or both, may have a Sweat Management Index of about 100 or less, about 90 or less, or about 85 or less.

Any of the layered materials as shown herein may have one or more facing layers one or more scrim layers, or both. For example, a facing layer (or scrim) may be positioned on a surface of a fibrous layer, facing away from the moisture transport layer. It is also contemplated that the fibrous layers, moisture transport layers, outer layers, adhesive layers, and surface layers may be configured in any combination and order The material as described herein may include printing such as logos, washing instructions, sizing information, or the like. Preferably, fabric printing methods that do not plug pores of the fabric, such as sublimation printing, may be employed, so functionality of the fabric is not impacted.

Any of the materials described herein may be combined with other materials described herein (e.g., in the same layer or in different layers of the layered material). The layers may be formed from different materials. Some layers, or all of the layers, may be formed from the same materials, or may include common materials or fibers. The type of materials forming the layers, order of the layers, number of layers, positioning of layers, thickness of layers, or a combination thereof, may be chosen based on the desired properties of each material (e.g., wicking properties, cooling properties, insulative properties, and the like), the desired air flow resistive properties of the material as a whole, the desired weight, density and/or thickness of the material, the desired flexibility of the material (or locations of controlled flexibility), or a combination thereof. The layers may be selected to provide varying orientations of fibers.

While described in the context of an insert, it is contemplated that the layered material may be worn without the use of additional headwear. For example, the layered material may be formed into a headband. The material may also be used on products such as sport glasses, goggles, face shields, and the like.

While described as having an elongated body, the material may instead be shaped into a material covering more of the user's head. For example, instead of being a strip of material, the layered product may be formed into a generally hemispherical shape. Such shape may allow for greater (or even total) coverage within the headwear, such as a helmet. Prior to forming the three-dimensional shape, the material may have one or more cutouts or areas of fewer layers (e.g., areas without a fibrous interior layer) that allow the material to be folded, bent, curved, thermoformed, molded, or the like, into the desired shape without excess material.

The layered material of the present teachings may have a saturation point that is greater than the saturation point of other traditional wicking and/or cushioning materials (e.g., polyurethane foams). However, the layered material may exceed its saturation point, at least in certain areas of the material. A moisture reservoir may be added to the layered material to guide moisture (e.g., excess moisture). The moisture reservoir may be added to one or more edges, or part of an edge, to serve as a receptacle and guide for moisture not absorbed within the material. For example, a moisture reservoir may be added to the bottom edge of a material to keep sweat from dripping into the wearer's eyes. The moisture reservoir may act as an overflow mechanism for moisture that may leak out of the layered material. The moisture reservoir may guide the moisture to the sides of the material to be absorbed by the layered material in a less saturated location, to drip off in another area, or to contain the moisture until enough moisture within the layered material has evaporated and the material is no longer at its saturation point. The moisture reservoir may be integrally formed with the layered material at an edge of the material. The moisture reservoir may be a separate piece from the layered material. The moisture reservoir may be removable and/or repositionable. The moisture reservoir may be, for example, a gasket that clips on or is otherwise secured around the edge of the layered material. The gasket may be formed of a nonpermeable material. The gasket may have a generally U-shaped cross-section, where portion of the straight edges are located on opposing sides of the layered material. The gasket may have a generally J-shaped or backwards J-shaped cross-section. The gasket may have one or more curved sections when looking at its cross-section. The gasket may have one or more generally straight or linear sections when looking at its cross-section.

Turning now to the figures, FIG. 1 illustrates a cross section of an absorbing article 10 in accordance with the present teachings. The absorbing article 10 includes a fibrous layer 12 sandwiched between two layers. One or both layers may be wicking layers. An interior wicking layer 14 is adapted to contact a source of moisture, such as a user's head, scalp, forehead, or combination thereof. An exterior layer 16 is located on the opposing side of the fibrous layer 12 and is adapted to contact an article of headwear, such as a helmet.

Figure 2:
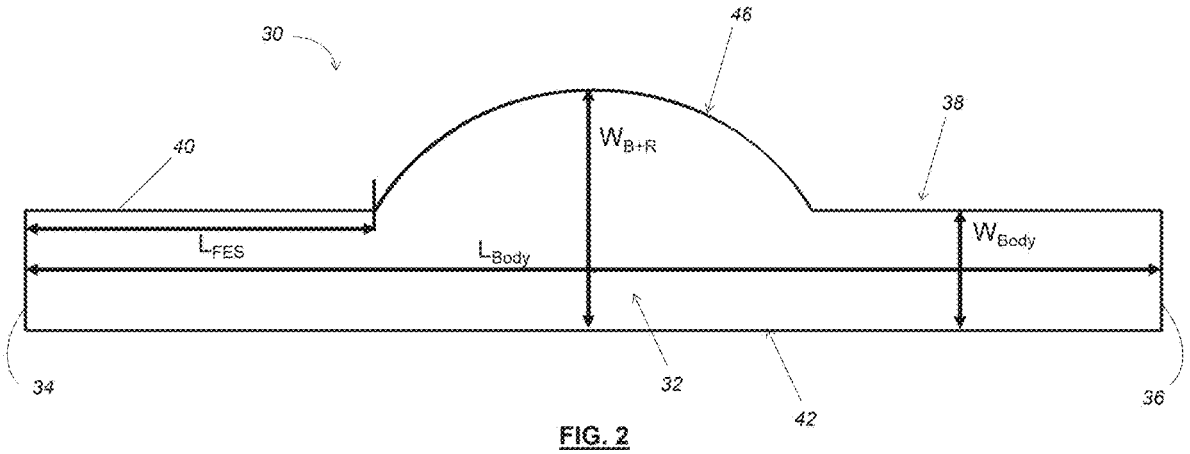
FIG. 2 is an exemplary pad in accordance with the present teachings.

FIG. 2 illustrates an exemplary absorbing article, shown as a pad or insert 30. The pad 30 includes a body portion 32 having a first short edge 34 and an opposing second short edge 36. The pad 30 is further defined by a first long edge 38 and an opposing second long edge 42. The body portion 32 has a length $L_{Body}$ (measured from the center of the body and extending along the longitudinal axis) and a width $W_{Body}$. The pad includes a ridge 46 extending away from the body portion 32. The ridge 46 extends the width of the pad to a maximum combined width of the body and ridge width at $W_{B+R}$. The ridge 46 is generally centrally located as shown, though it is contemplated that other positions of the ridge are possible. It is also contemplated that multiple ridges are possible. A first long edge segment 40 extends from the respective short edges 34, 36 to the ridge 46. The first long edge segment 40 has a length $L_{FES}$. The dimensions of the pad or insert 30 allow for the pad to be positioned within an article of headwear, such as a helmet.

Figure 3:
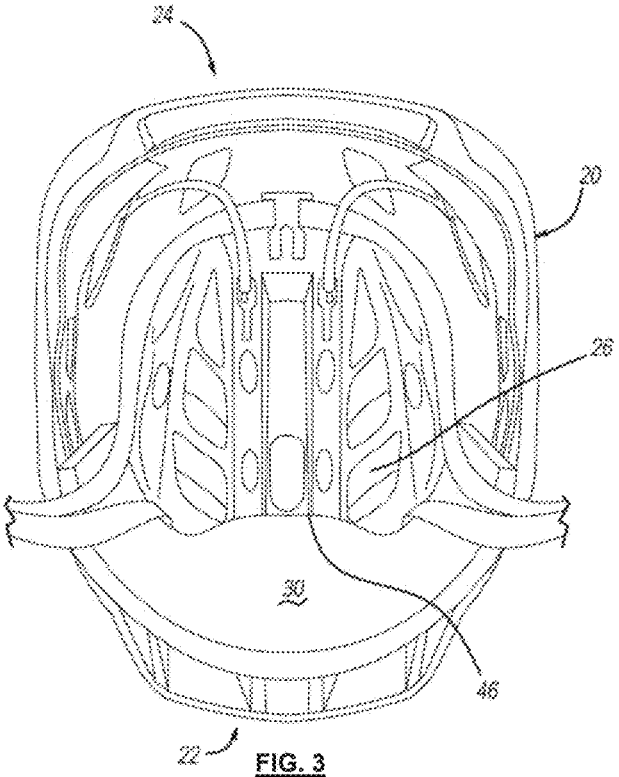
FIG. 3 shows the exemplary pad of FIG. 2 installed within an exemplary headwear item.

FIG. 3 illustrates the pad or insert 30 of FIG. 2 positioned within a helmet 20. The helmet 20 has a forward end 22 and a rearward end 24 and a plurality of air vents 26. As shown, the pad or insert 30 is positioned at the forward end 22 of the helmet 20. The ridge 46 extends upwardly toward the top of the helmet and toward the air vents 26 to guide wicked moisture toward the air vents 26 and encourage evaporation of the moisture.

Figure 4:
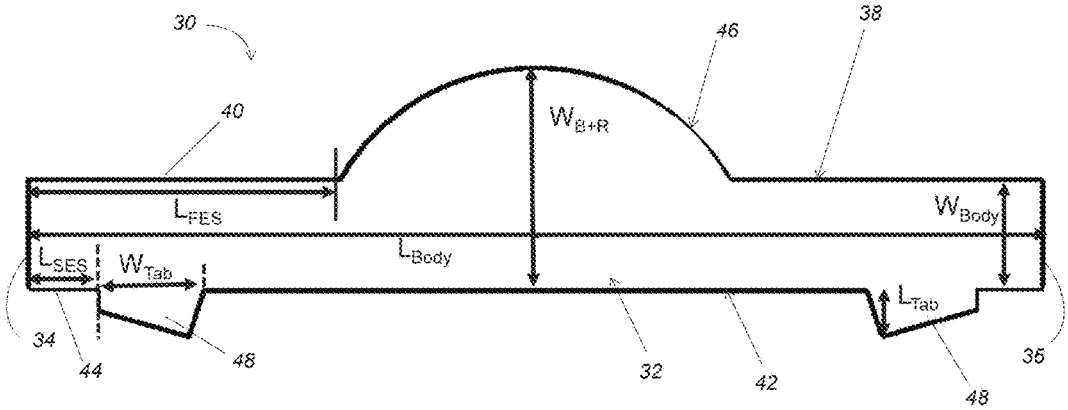
FIG. 4 is an exemplary pad in accordance with the present teachings.
Figure 5:
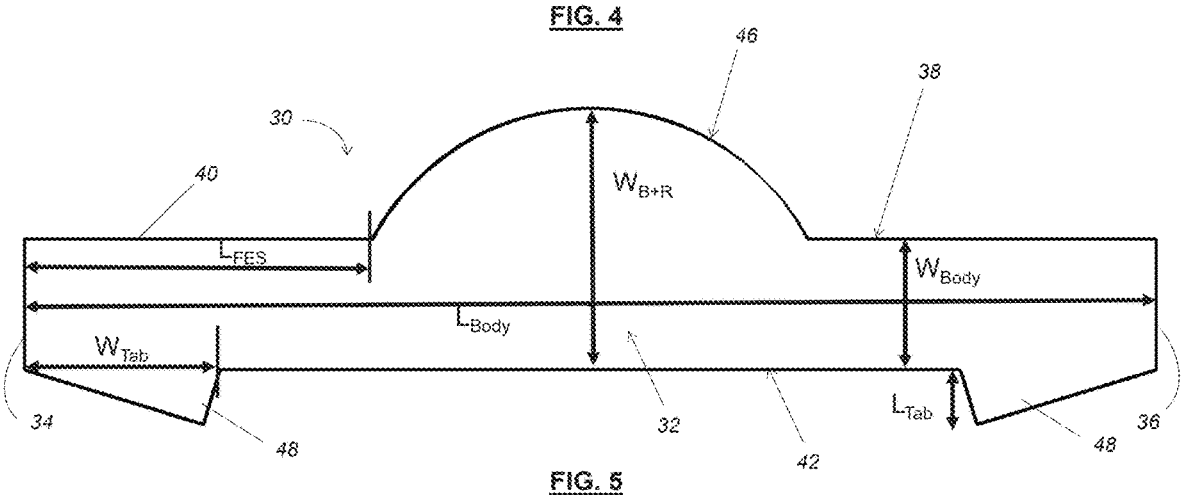
FIG. 5 is an exemplary pad in accordance with the present teachings.
Figure 6:
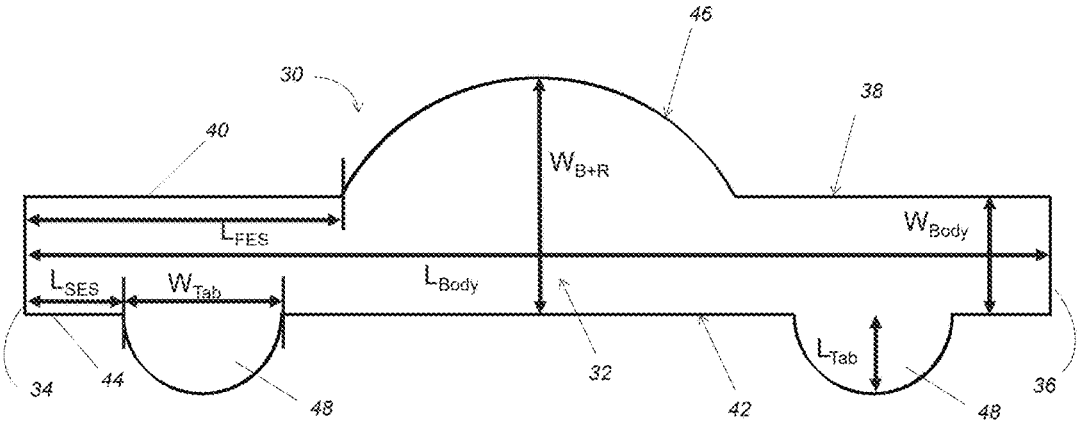
FIG. 6 is an exemplary pad in accordance with the present teachings.

FIGS. 4, 5, and 6 illustrate exemplary absorbing articles, shown as a pad or insert 30. The pad 30 includes a body portion 32 having a first short edge 34 and an opposing second short edge 36. The pad 30 is further defined by a first long edge 38 and an opposing second long edge 42. The body portion 32 has a length $L_{Body}$ (measured from the center of the body and extending along the longitudinal axis) and a width $W_{Body}$. The pad includes a ridge or lobe 46 (referred to as a ridge for simplicity) extending away from the body portion 32. The ridge 46 extends the width of the pad to a maximum combined width of the body and ridge width at $W_{B+R}$. The ridge 46 is generally centrally located as shown, though it is contemplated that other positions of the ridge are possible. A first long edge segment 40 extends from the respective short edges 34, 36 to the ridge 46. The first long edge segment 40 has a length $L_{FES}$. The dimensions of the pad or insert 30 allow for the pad to be positioned on a wearer's head and/or within an article of headwear, such as a helmet. The pad 30 also includes tabs 48 extending from the second long edge 42. The tabs 48 each have a maximum length $L_{Tab}$ measured from the second long edge 42 to the tip of the longest portion of the tab. In FIGS. 4 and 6, the tabs are positioned such that a second long edge segment 44, having a length $L_{SES}$, extends between the respective short edges 34, 36 to the tab 48. In FIG. 5, the tabs begin at the respective short edges 34, 36 and extend at an angle toward the maximum length. The tabs have a width $W_{Tab}$.

Figure 7:
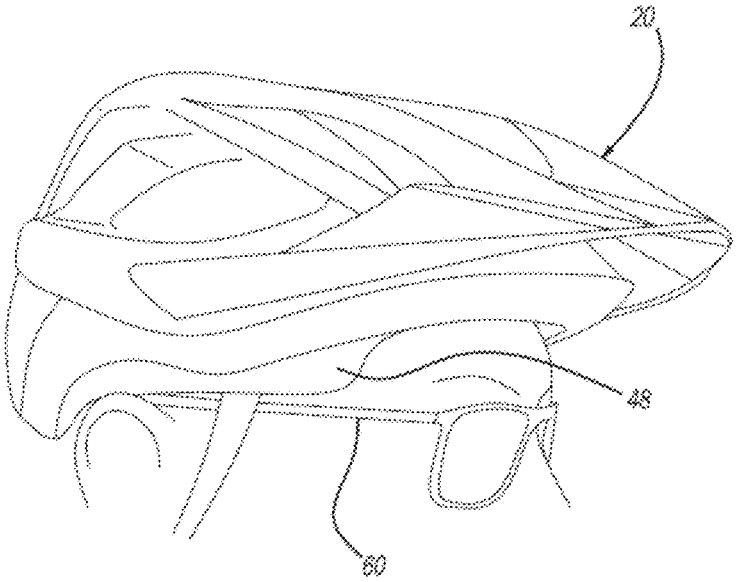
FIG. 7 shows the exemplary pad of FIG. 4 or FIG. 5 installed within an exemplary headwear item.

The tabs 48 of the pad 30 of FIGS. 4 and 5 may be positioned such that when curved to fit into a helmet 20 or other headwear, the edge of each tab 48 is adapted to contact a wearer's glasses 60, as shown in FIG. 7. This tab 48, therefore, may act to prevent moisture from dripping onto the arms of a wearer's glasses 60 and then traveling toward the wearer's face. The tabs of FIG. 6 are rounded or generally curved. The tabs may contact the wearer's temple, glasses, or both.

Figure 8:
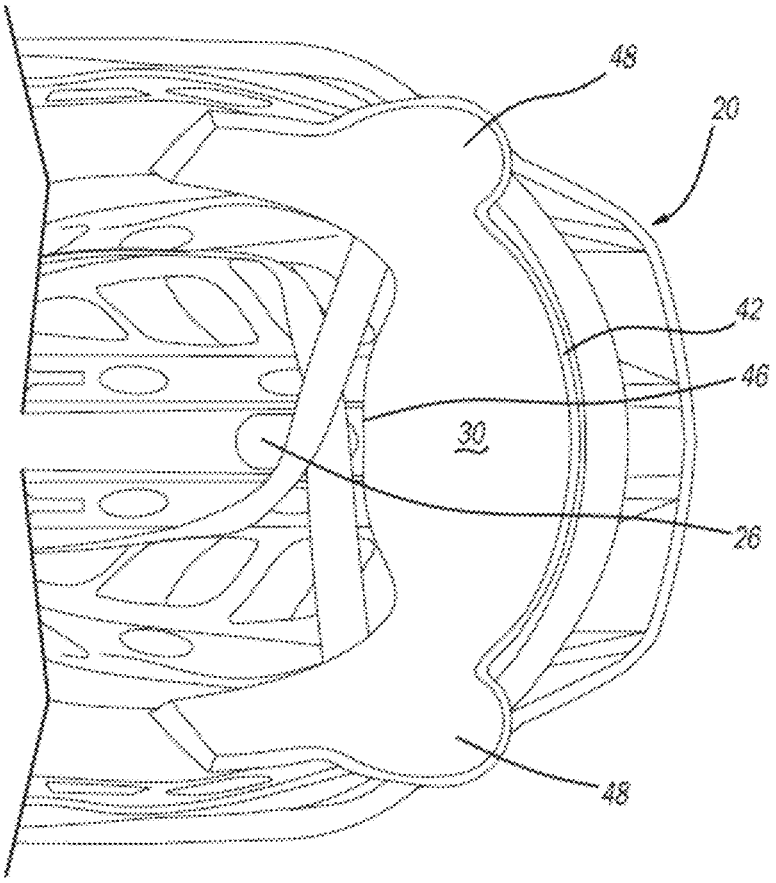
FIG. 8 shows the exemplary pad of FIG. 6 installed within an exemplary headwear item.

FIG. 8 illustrates the pad 30 of FIG. 6 positioned within a helmet 20. The ridge 46 extends upwardly toward the top of the helmet and toward the air vents 26 to guide wicked moisture toward the air vents 26 and encourage evaporation of the moisture. The second long edge 42 is generally aligned with the edge of the helmet 20. The tabs 48 extend away from the helmet (i.e., downwardly when the helmet is in use).

Figure 9:
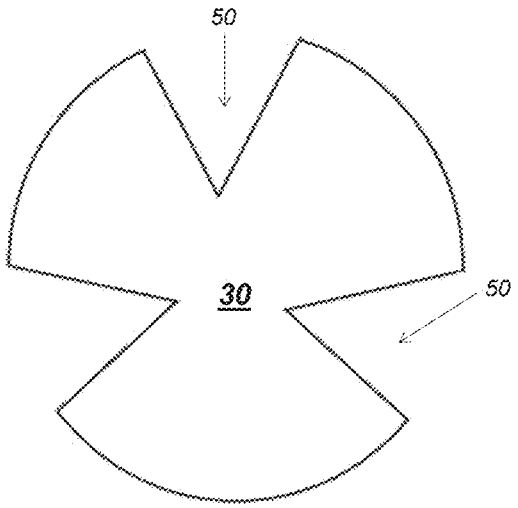
FIG. 9 is an exemplary pad in accordance with the present teachings.
Figure 10:
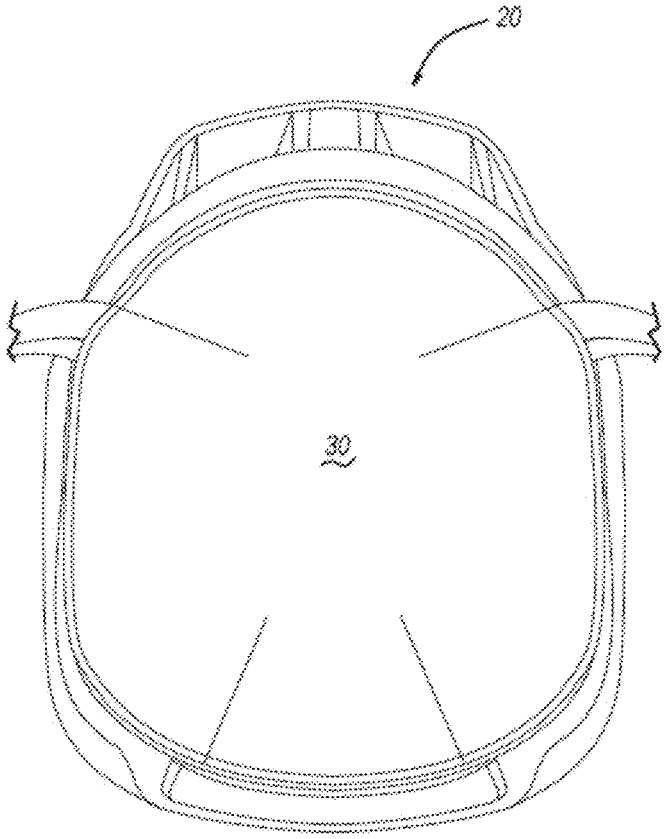
FIG. 10 shows the exemplary pad of FIG. 9 installed within an exemplary headwear item.

FIG. 9 illustrates an exemplary absorbing article, shown as a pad or insert 30. The article, when flat, has a plurality of cutouts 50. The cutouts 50 may allow for shaping of the pad 30 into a desired three-dimensional shape, such as a curved or generally hemispherical shape to be positioned within a helmet 20, as shown in FIG. 10. The absorbing article may be adapted to contact the wearer's head, scalp, forehead, or a combination thereof. It is also contemplated that the tabs shown in FIGS. 4-6 may also be incorporated. While shown as filling the helmet, it is contemplated that the pad or insert if FIGS. 9 and 10 may only fill a portion of the helmet (e.g., a forward half or other portion located at or near the forward end of the helmet).

Figure 11:
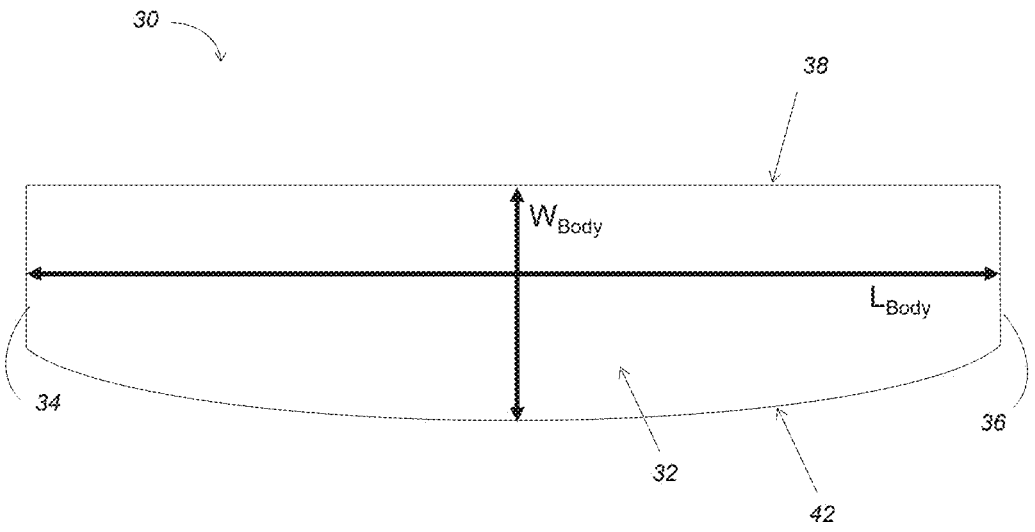
FIG. 11 is an exemplary pad in accordance with the present teachings.

FIG. 11 illustrates an exemplary absorbing article, shown as a pad or insert 30. The pad 30 is defined by a first long edge 38 and an opposing second long edge 42. The pad 30 is further defined by a first short edge 34 and an opposing second short edge 36. The body portion 32 has a length $L_{Body}$ (measured from the center of the body and extending along the longitudinal axis) and a width $W_{Body}$. As shown herein, the width $W_{Body}$ is measured from the first long edge 38, which is generally straight, to an opposing point on the opposing second long edge 42, where the width is at its maximum. While shown herein as a generally arcuate second long edge 42, it is contemplated that the second long edge 42 may be generally straight or may have one or more generally straight segments. For example, the second long edge 42 may have generally curved portions toward the short edges 34, 36 of the material but may have a generally straight segment at a generally central location. Such an arrangement may, for example, allow for a particular width throughout the body of the pad or insert and a shorter width approaching the short edges (or shorter length of the short edges).

Figure 12:
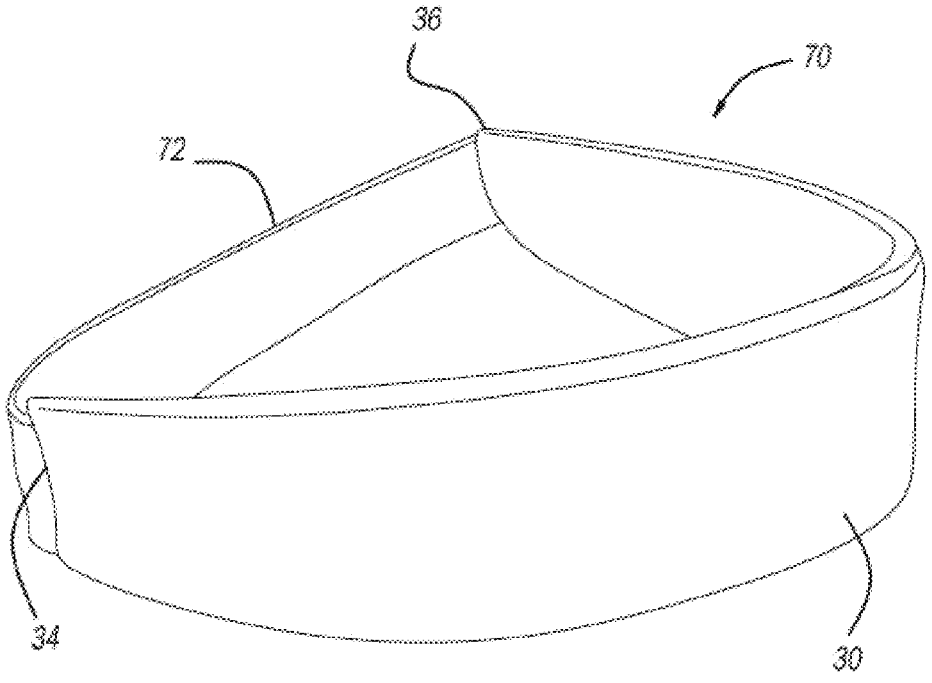
FIG. 12 is an exemplary headband in accordance with the present teachings.

FIG. 12 illustrates an exemplary absorbing article, shown as a headband 70. The headband 70 includes a pad 30 having a first short edge 34 joined to a second short edge 36 by a strap 72. The strap as shown is a continuous piece of elastic material, though the strap may be formed from multiple pieces. For example, the strap may be formed from one piece extending from the first short edge 34 and another piece extending from the second short edge 36, where the pieces may be tied together or otherwise secured together (e.g., via hook and loop fastener) to achieve a desired fit around the head of a wearer and/or to secure the pad to the wearer's forehead and/or hairline.

Figure 13:
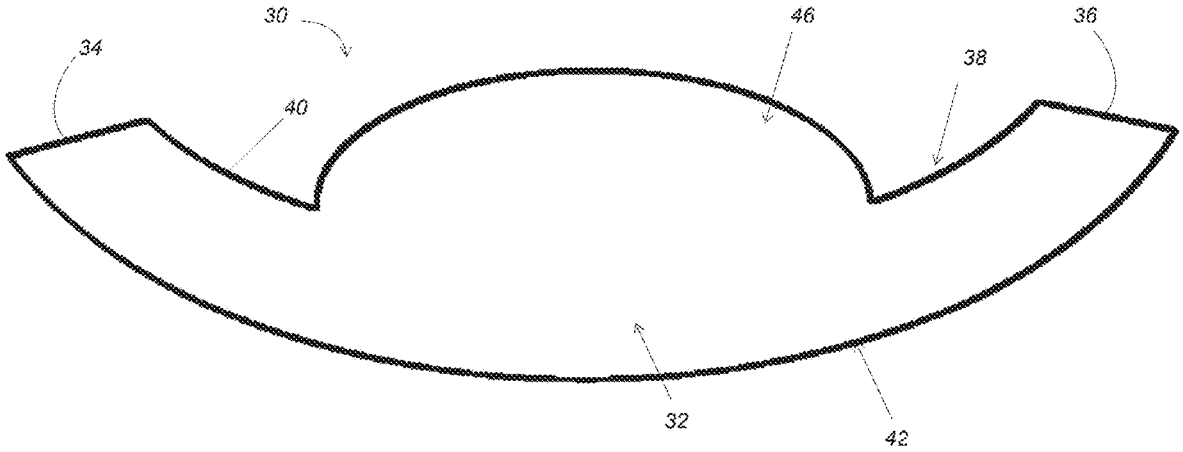
FIG. 13 is an exemplary pad in accordance with the present teachings.

FIG. 13 illustrates an exemplary absorbing article, shown as a pad or insert 30 having a first long edge 38 and an opposing second long edge 42. The pad 30 is further defined by a first short edge 34 and an opposing second short edge 36. If the pad is to be used as a headband, one or more straps or other securing features may be joined to the short edges (e.g., as shown in FIG. 12). The pad includes a ridge 46 extending away from the body portion 32. A first long edge segment 40 extends from the respective short edges 34, 36 to the ridge 46. The ridge 46 extends the width of the pad to a maximum combined width of the body and ridge. The ridge 46 is generally centrally located as shown, though it is contemplated that other positions of the ridge are possible.

One or more edges may be a generally curved or arcuate edge. One or more edges may have one or more segments that have a generally curved or arcuate edge. Such curvature may allow for the pad or insert to be positioned on a wearer's forehead and positioned around a portion of the wearer's head in a desired orientation. The curvature may allow for the pad or insert to fit around the contours of the wearer's head. The long edges may give the appearance of being generally straight (instead of curved) while positioned on and around the wearer's head. While shown herein as a generally arcuate first long edge 38 (or generally arcuate first long edge segments 40) and a generally arcuate second long edge 42, it is contemplated that one of the edges may be generally straight or may have one or more generally straight segments. For example, the second long edge 42 may have generally curved portions toward the short edges 34, 36 of the material but may have a generally straight segment at a generally central location. Such an arrangement may, for example, allow for a particular width throughout the body of the pad or insert and a shorter width approaching the short edges (or shorter length of the short edges).

Figure 14:
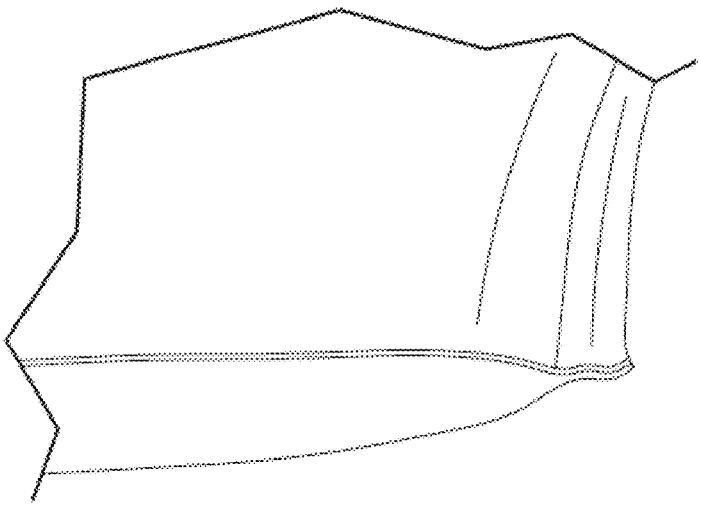
FIG. 14 shows an exemplary edge of the material.

FIG. 14 illustrates an exemplary edge of the article, where the edges have been sealed by heated pinch edge sealing to bond the layers together. The edge is compressed and can be trimmed to remove excess material.

Figure 15A:
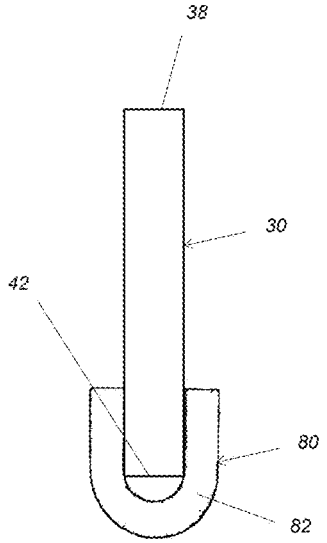
FIGS. 15A and 15B illustrate side or cross-sectional views of exemplary pads with exemplary moisture reservoirs.
Figure 15B:
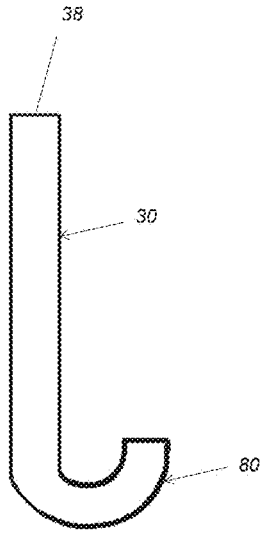

FIGS. 15A and 15B illustrate exemplary methods of channeling additional moisture (e.g., upon exceeding a saturation point of a pad 30). The figures show a side view of an exemplary absorbing article, shown as a pad or insert 30 having a first long edge 38 and a moisture reservoir 80 located at an opposing edge. As shown in FIG. 15A, there is an opposing second long edge 42 and a gasket 82 is attached at the second long edge. The gasket 82 is shown as a generally U-shaped piece that can clip or otherwise be secured at the second long edge to collect additional moisture (e.g., sweat) into a reservoir and direct the moisture toward the short edges of the pad. The gasket may extend around all or part of the second long edge. As shown in FIG. 15B, the moisture reservoir 80 may be integrally formed or otherwise attached to the pad 30. This may form a generally J-shaped or backwards J-shaped cross-section. The moisture reservoir 80 may direct moisture toward the edges of the pad to keep moisture from dripping down the face of the wearer, for example. The moisture reservoir may be positioned toward the wearer's face or away from the wearer's face.

Figure 16A:
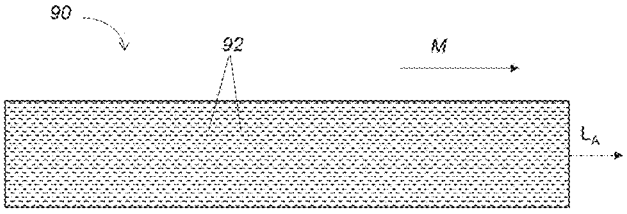
FIGS. 16A and 16B illustrate an exemplary carded fibrous material.
Figure 16B:
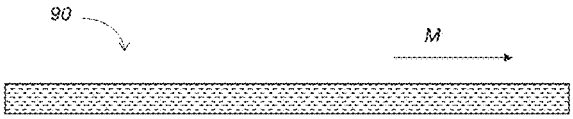

FIGS. 16A, 16B, 17A, and 17B illustrate fiber orientation and lap orientation in an exemplary pad or insert. FIG. 16A illustrates a top view of a carded fibrous material 90. The fibers 92 extend generally in the machine direction M. The fibers 92 extend generally parallel to the longitudinal axis $L_A$ of the carded fibrous material. FIG. 16B illustrates a side view, or a view of the thickness, of the carded fibrous material 90. The fibers 92 extend generally in the machine direction M. For simplicity of the figures, the fibers are illustrated as a dashed pattern.

Figure 17A:
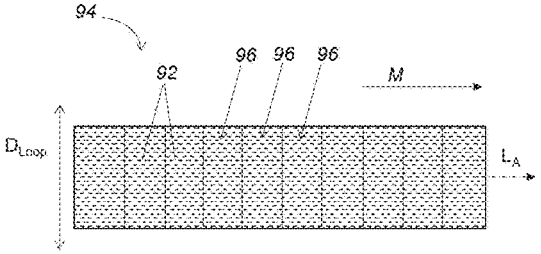
FIGS. 17A and 17B illustrate an exemplary carded and lapped fibrous material.
Figure 17B:
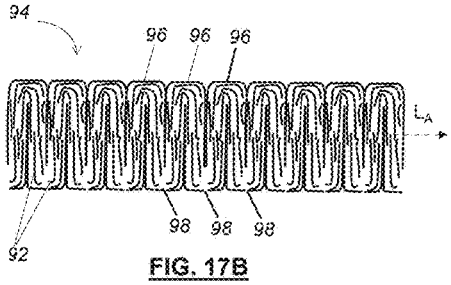

FIG. 17A illustrates a top view of the carded fibrous material of FIG. 16A after undergoing lapping (e.g., vertical lapping) to form a carded and lapped fibrous material 94. FIG. 17B illustrates a side view, or a view of the thickness or cross-section, of the carded and lapped fibrous material 94. The carded and lapped fibrous material 94 as shown is in an uncompressed state, though it is contemplated that a final pad or insert may undergo one or more compression operations or one or more operations that result in a compressed carded and lapped fibrous material. Lapping produces a structure with upper loops 96 and lower loops 98. From the top view of FIG. 17A, looking down at the upper loops 96, the fibers 92 are seen to still generally follow the machine direction. For simplicity of the figure, the fibers are illustrated as a dashed pattern. From the side view of FIG. 17B, the fibers 92 are seen to follow the undulating shape, where the fibers 92 at the upper loops 96 and lower loops 98 may curve, and the fibers between the loops are in a generally vertical orientation (or extending in a direction generally perpendicular to the longitudinal axis of the material). In FIG. 17A, the upper loops 96 (as well as the lower loops 98 of FIG. 17B) run generally perpendicular to the machine direction M and/or generally perpendicular to the longitudinal axis $L_A$ of the material. The direction of the loops (e.g., following the uppermost or lowermost line of the loop across the surface of the material) is denoted as $D_{Loop}$. The direction of the loops in FIG. 17B is into the page.

The carded and lapped fibrous material 94 may be the fibrous layer 12 of the absorbing article 10 of FIG. 1. In a pad or insert having the carded and lapped fibrous material 94, when positioned on a wearer's forehead, the upper loops and lower loops may run up and down or vertically on the wearer's forehead (e.g., as opposed to running across the wearer's forehead). Depending on how the material is situated and how the material is exposed to air flow, air may flow through and/or across the pad or carded and lapped fibrous material 94. Air flow across the pad or carded and lapped fibrous material may be generally parallel to the direction of the loops. Air flow through the pad may be through the thickness of the pad (e.g., generally parallel to the generally vertical fibers extending between loops when in an uncompressed state).

While FIGS. 17A and 17B show the direction of the loops generally perpendicular to the machine direction, it is contemplated that in certain applications the direction of loops would be parallel to the longitudinal axis of the material.

Any of the layered materials as shown herein may have one or more facing layers one or more scrim layers, or both. For example, a facing layer (or scrim) may be positioned on a surface of a fibrous layer, facing away from the moisture transport layer. It is also contemplated that the fibrous layers, moisture transport layers, outer layers, adhesive layers, and surface layers may be configured in any combination and order.

Illustrative Examples

The below examples are intended to be illustrative examples of the present teachings and are not intended to serve as limiting.

Testing pertaining to drying, draining, and air permeability of the material in accordance with the present teachings has been performed. This testing also compares performance of the material in accordance with the present teachings with other competitive products as follows.

Where results refer to CCubed, this is a material in accordance with the present teachings. The CCubed materials as tested include a fibrous layer of carded and vertically lapped fibers. Where referred to as "CCubed Curved w/Lobe," this is a shape similar to that shown in FIG. 13. Where referred to as "CCubed Straight, No Lobe," this is a shape similar to that shown in FIG. 11. Where referred to as "CCubed Straight w/Lobe," this is a shape similar to that shown in FIG. 2. The "lobe" as referred in the tests is also referred to herein as a ridge.

Competitive products tested are the following. Where results refer to "Nylon-Polyester-Lycra Prem.," this is a 3-5 mm thick woven synthetic stretch band (2.875 inches wide), made up of 63% Nylon, 23% PET, and 14% Lycra. Where results refer to "Nylon-Polyester-Lycra Std.," this is a 1-2 mm thick woven synthetic stretch band (1.813 inches wide), made up of 63% Nylon, 23% PET, and 14% Lycra. Where results refer to "Polyester-Elastane Ladies Band," this is a 3-5 mm thick woven synthetic elastic band (2 inches wide), made up of 86% PET and 14% Elastane. Where results refer to "Thin-Synthetic—Std.," this is a 1-2 mm thin woven synthetic PET elastic band (2.875 inches wide and tapers down to 7/16 inch). Where results refer to "3 mm N.P. PET Fiber," this is a 3.4 mm thick nonwoven needlepunched PET core (250 gsm) with woven PET fabric outer covering (1.75 inches wide). Where results refer to "6 mm N.P. PET Fiber," this is a 6 mm thick nonwoven needlepunched PET core (545 gsm) with woven PET fabric outer covering (1.75 inches wide).

Dynamic Drying Test

A Dynamic Drying Test is performed to capture the maximum supersaturated liquid holding capacity, the saturated liquid holding capacity, and the entire evaporative drying curve in real-time dynamic mode of a material. This is done in a controlled environment (temperature/humidity) that does not have forced air currents. Maximum saturated holding capacity is determined when dripping stops and the drying curve becomes a continuous monotonoic decreasing function.

This test enables one to understand the holding capacity, the draining and dripping dynamics, the shape of the evaporative drying curve, average drying rate, and total drying time of a material. This information is relevant to designing a material that is made to hold a certain amount of sweat and to evaporate it (dry) effectively, especially when these dynamics can vary due to the amount of sweat that is in the material.

To set up the test, there is a mass balance configured in dynamic mode, connected to a laptop computer via USB cable, which enables the balance to pipe mass/time data to the computer. The computer has a programmed spreadsheet which talks to the balance to commence the test, control the acquisition rate, and to log the data (mass vs time).

Once the experiment is over, the mass vs time data is analyzed to determine the maximum supersaturated holding capacity, the draining/dripping portion of the curve, the saturated holding capacity, the shape of the evaporative drying curve, the average drying rate over the course of the experiment, and the total dry time. Further data analysis can be done on the data.

The sample and sample holding fixture are on the balance and tared such that the balance is only reading the mass of the water in the specimen. The bucket of water used to wet the specimen is off the balance and used to capture any water draining/dripping such that this water does not compromise the balance readout of the remaining water in the specimen which is being recorded in dynamic mode.

The mass balance and sample holding fixture are in an enclosed environment to control temperature/humidity fluctuations, and to minimize air currents.

In performing the test, a hanging rig is tared on the balance and the specimen is hung freely above a bucket of water. The dry mass of the specimen is recorded and the balance is tared again so the balance will only read the water content in the specimen.

The water bucket is raised up to submerge the specimen. The specimen is allowed to remain submerged for 15 minutes to enable maximum uptake of water. If the specimen (such as an open cellular foam) floats and won't submerge, it is physically squeezed to force all of the trapped air out so it can uptake the full amount of water.

After 15 minutes, the program on the computer is started to begin the data acquisition, the water bucket is quickly lowered to expose the specimen and locked in place, and the enclosure is quickly closed to allow the experiment to continue.

After the specimen is dry or the experiment is deemed to be complete, the program is stopped and the data is saved for further analysis. The starting point of the experiment is determined by analyzing the data to identify the highest mass point on the curve, with a smooth falling curve after that point. Data before that point are discarded as it will be obvious that this data occurred during the handling of the bucket of water in contact with the specimen during the commencement of the experiment.

Figure 18:
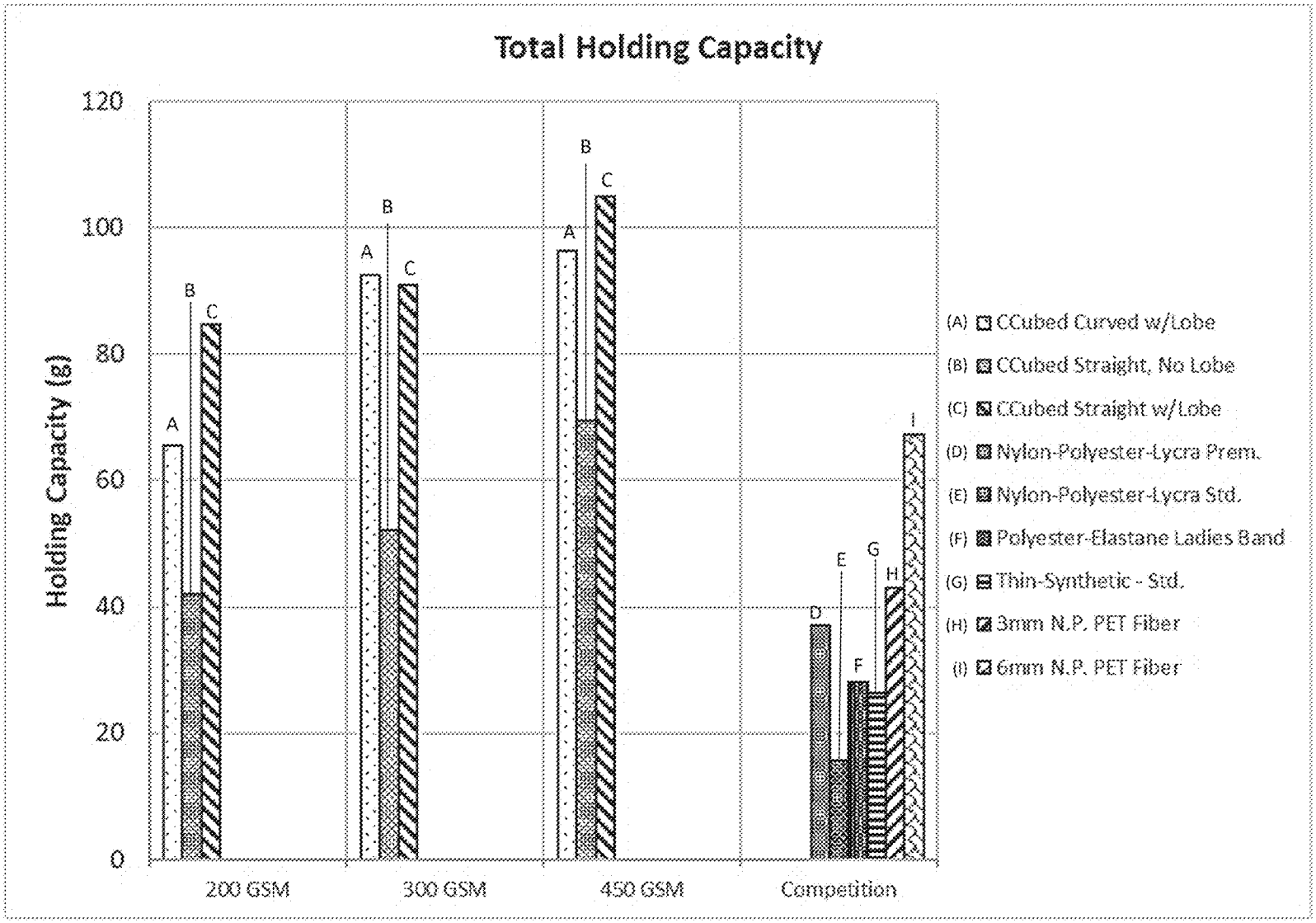
FIG. 18 is a graph showing the total holding capacity of various materials.

FIG. 18 is a graph showing the total holding capacity of various materials under the dynamic drying test. The materials with the CCubed designation are tested at various weights: 200 gsm, 300 gsm, and 450 gsm. The results in FIG. 18 show that lobed versions hold more than straight versions since the lobed versions are larger, with more area and mass. The holding capacity of the CCubed that is straight with the lobe is slightly larger than the curved CCubed with the lobe, so the straight CCubed with the lobe holds more water. Thinner and sometimes lighter competitive materials cannot hold as much.

Figure 19:
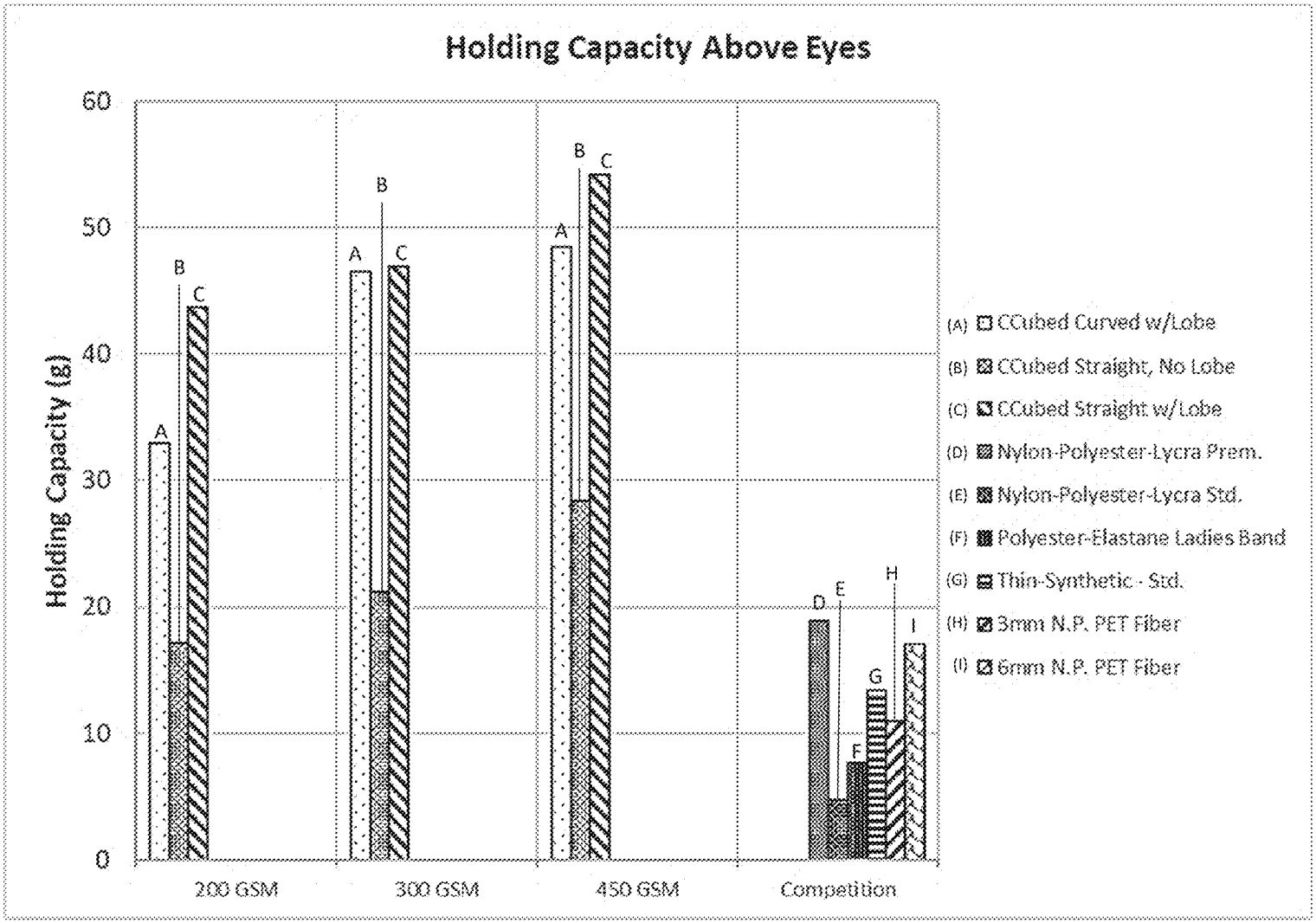
FIG. 19 is a graph showing the holding capacity above the eyes of various materials.

FIG. 19 is a graph showing the holding capacity of various materials above the eyes under the dynamic drying test. These results are intended to show the holding capacity of a headband or headwear insert in the area above the eyes of the wearer. The data of FIG. 18 are normalized to the key treatment area of interest above the eyes for a headband-type application.

Figure 20:
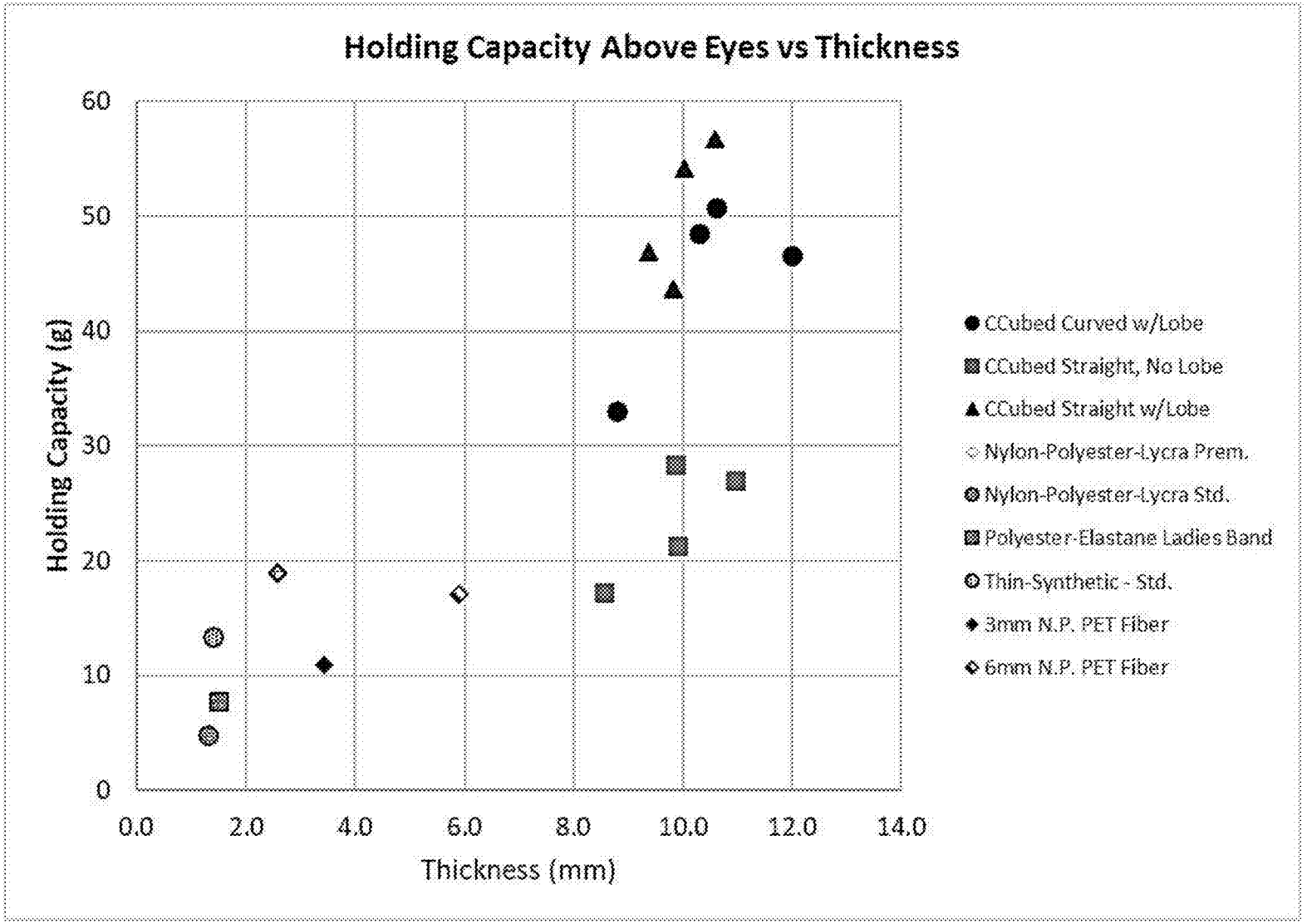
FIG. 20 is a graph showing the holding capacity above the eyes of various materials vs thickness.

FIG. 20 is a graph showing the holding capacity above the eyes versus thickness. The results indicate that as the material gets thicker, it can hold more water. This is due to the increased free volume space within the material to hold water. Competitive materials are much thinner and more densified, so they cannot hold as much water. The thicker, lofted, vertically lapped material performs better.

Figure 21:
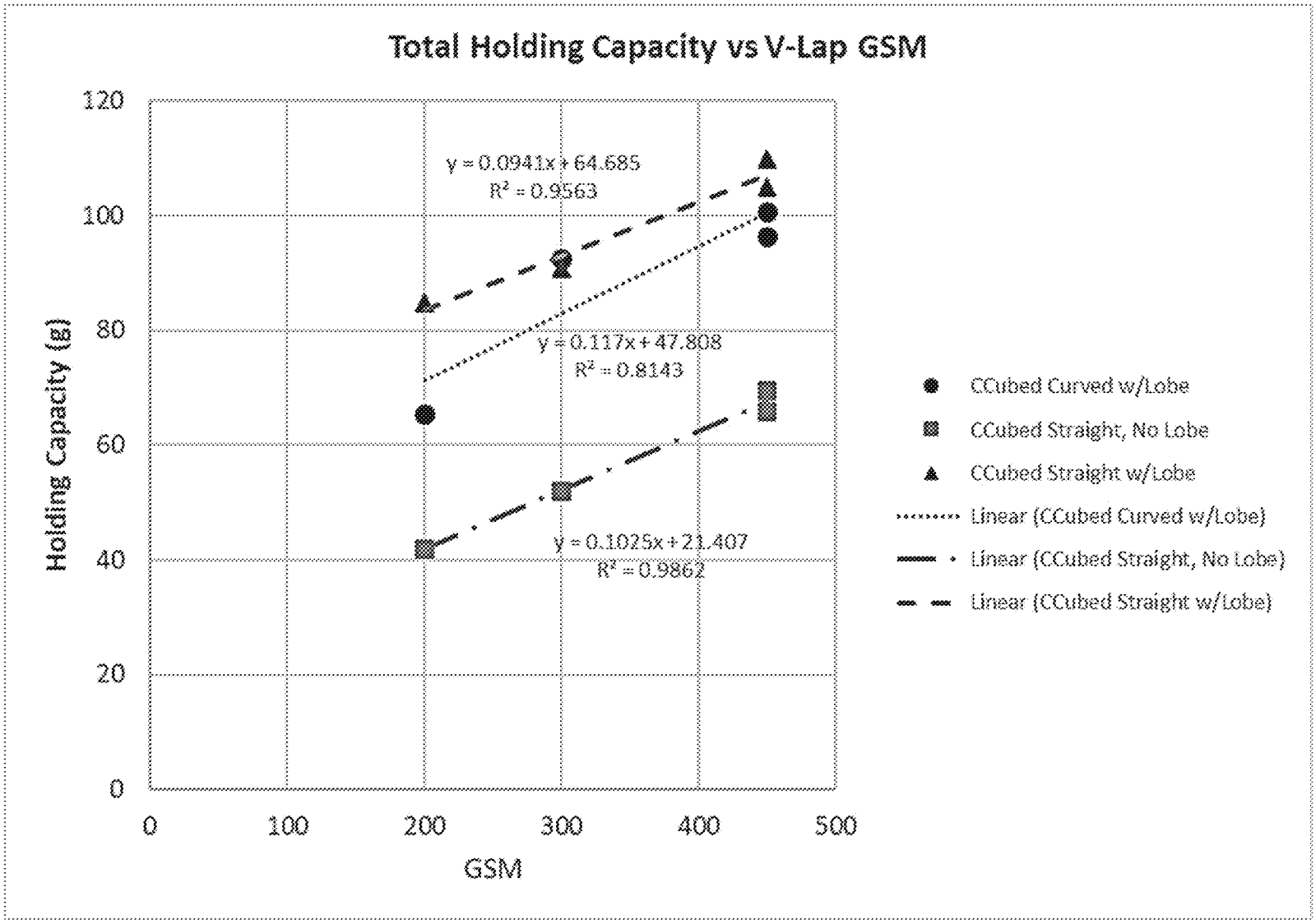
FIG. 21 is a graph showing the total holding capacity of various materials versus the weight of the material (gsm)

FIG. 21 is a graph showing the total holding capacity of the materials with a CCubed designation versus the weight of the vertically lapped material. The results show that as mass or number of fibers per unit volume increases, the holding capacity increases, as there is more fiber surface area present for water to adhere to.

Helmet Drying Test

A Helmet Drying Test is performed to simulate a real world headband application where the user wears the headband under a vented helmet, similar to a bike helmet, in the presence of forced airflow.

This test enables one to understand the drying dynamics of a headband under a vented helmet with forced airflow, which is meant to simulate riding a bicycle. The shape of the evaporative drying curve, average drying rate, and total drying time are useful in understanding how the shape design, the material design, and the environmental conditions affect the performance of the headband.

The saturated liquid holding capacity, the entire evaporative drying curve, and total dry time are captured during the experiment. This test is run in a controlled laboratory environment.

A FLIR camera can be used to visualize the extent of evaporative cooling across the helmet and the material.

To set up the test, there is a 3D printed full size mannequin head, which is situated on a mass balance. The headband is placed appropriately on the mannequin head and the helmet is attached over the head and headband in the same spot and configuration every time.

The head, dry headband, and helmet are all tared on the balance, such that the mass of the water in the specimen is the recorded exclusively on the balance. A squirrel cage rectangular blower is positioned in front of the helmet in a fixed orientation such that the wind speed across the front of the helmet is 15-20 mph, which is recorded with a hand-held anemometer.

The mass vs time data is manually recorded by the technician, until the sample is dry.

Once the experiment is over, the mass vs time data is analyzed to determine the saturated holding capacity, the shape of the evaporative drying curve, the average drying rate over the course of the experiment, and the total dry time. Further data analysis can be done on the data.

To perform the test, the mass of the dry headband is measured and recorded. The dry headband is placed on the mannequin head, and the helmet is put in place. The blower is turned on and the windspeed is verified. The balance is then tared while the blower is on, to get an accurate zero reading with the wind blowing across the apparatus. The balance will then read only the water content of the headband once the experiment begins.

The headband is then taken off and saturated in a bucket of water for 15 minutes.

After 15 minutes, the headband is taken out of the bucket of water and allowed to bulk drain and drip, to the point where drips are fewer than one per second.

The saturated headband is placed appropriately on the mannequin head and the helmet is attached appropriately over the head and headband. Any excess water that drains out (typically less than 2 grams) is wiped up to ensure it doesn't contaminate the balance.

The test rig is then placed on the tared balance in the proper orientation. The blower is turned on and the starting mass/time is recorded to start the experiment. The wind speed of the blower is verified again with the anemometer.

Early on in the experiment, mass vs time data is recorded every 5 minutes until approximately half of the water has evaporated, then the frequency of data acquisition can be changed to once every 20 minutes until the specimen is dry.

A FLIR camera is recommended to take photos of the thermal profile of the system before the fan is turned on and at regular intervals after the fan is turned. This visualizes the evaporative heat transfer profile vs time as the air blow across the system and the water evaporates from the headband.

Once the experiment is over and the mass of the specimen doesn't change, any final mass offset on the balance is recorded and optionally subtracted from the mass vs time curve later (as deemed appropriate by the scientist).

Figure 22:
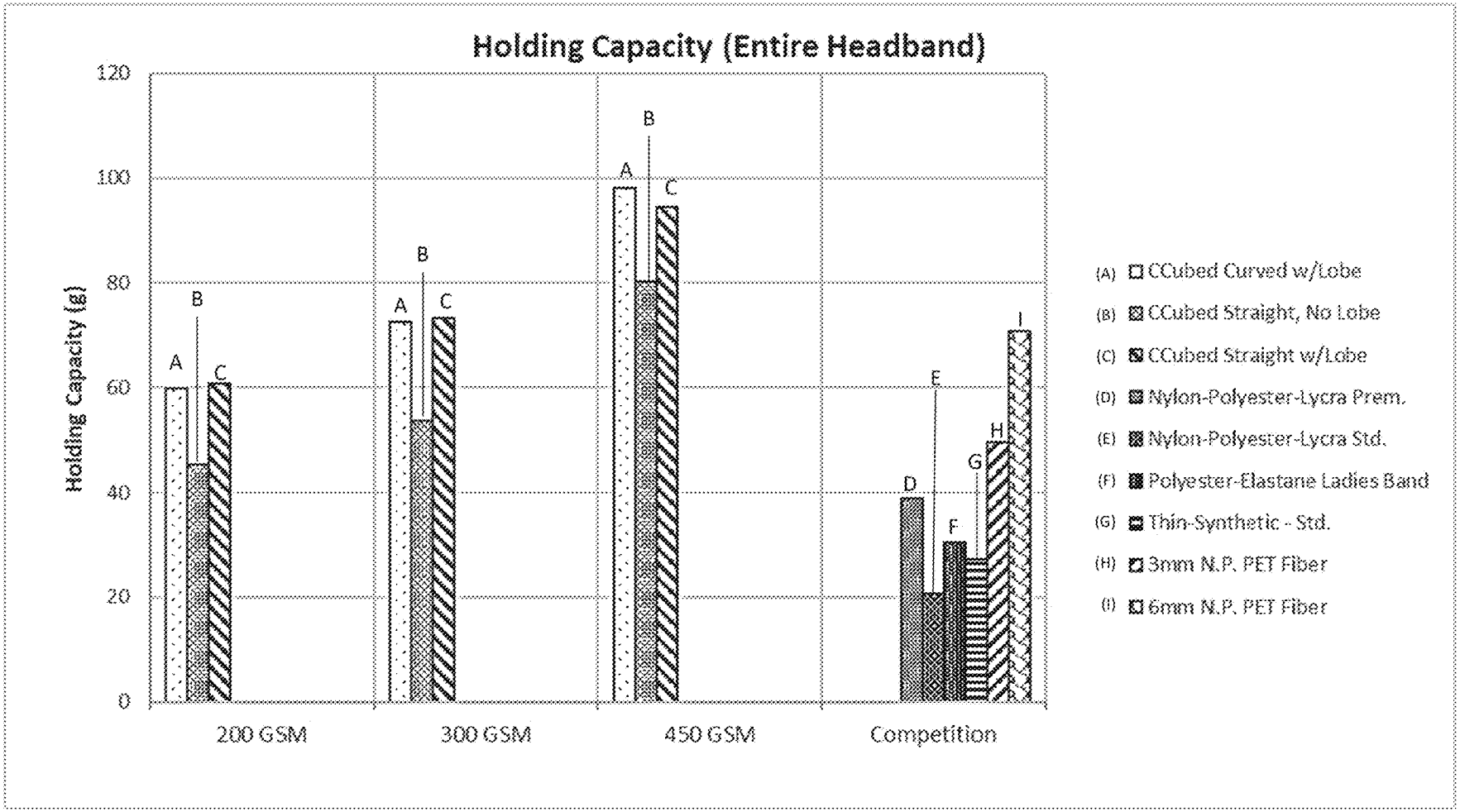
FIG. 22 is a graph showing the total holding capacity of various materials.

FIG. 22 is a graph showing the total holding capacity of various materials under the helmet drying test. The materials with the CCubed designation are tested at various weights: 200 gsm, 300 gsm, and 450 gsm. The results of FIG. 22 show that holding capacity on the CCubed lobed versions is similar since the surface area and design volume are similar. The non-lobed CCubed material holds less due to smaller design volume. The competition materials, except the 6 mm N.P. PET Fiber material, are thinner and have less design volume. These do not hold as much as the materials with the CCubed designation as a result.

Figure 23:
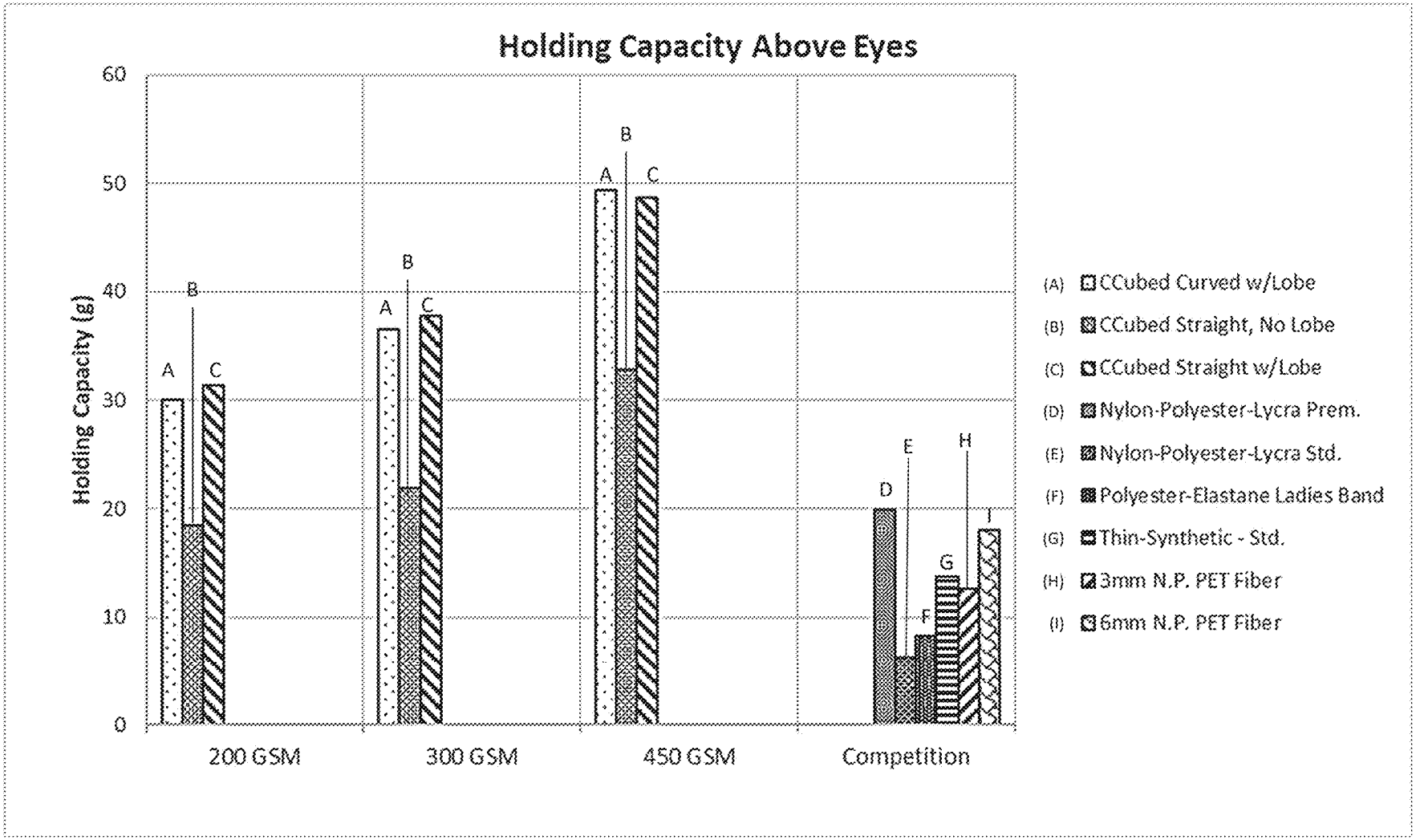
FIG. 23 is a graph showing the holding capacity above the eyes of various materials.

FIG. 23 is a graph showing the holding capacity of various materials above the eyes under the helmet drying test. These results are intended to show the holding capacity of a headband or headwear insert in the area above the eyes of the wearer. The data of FIG. 22 are normalized to the key treatment area of interest above the eyes for a headband-type application. The materials with the CCubed designation far outperform the competition materials due to greater surface area above the eyes with more area to soak up moisture and evaporate it more efficiently.

Drying Rate

Figure 24:
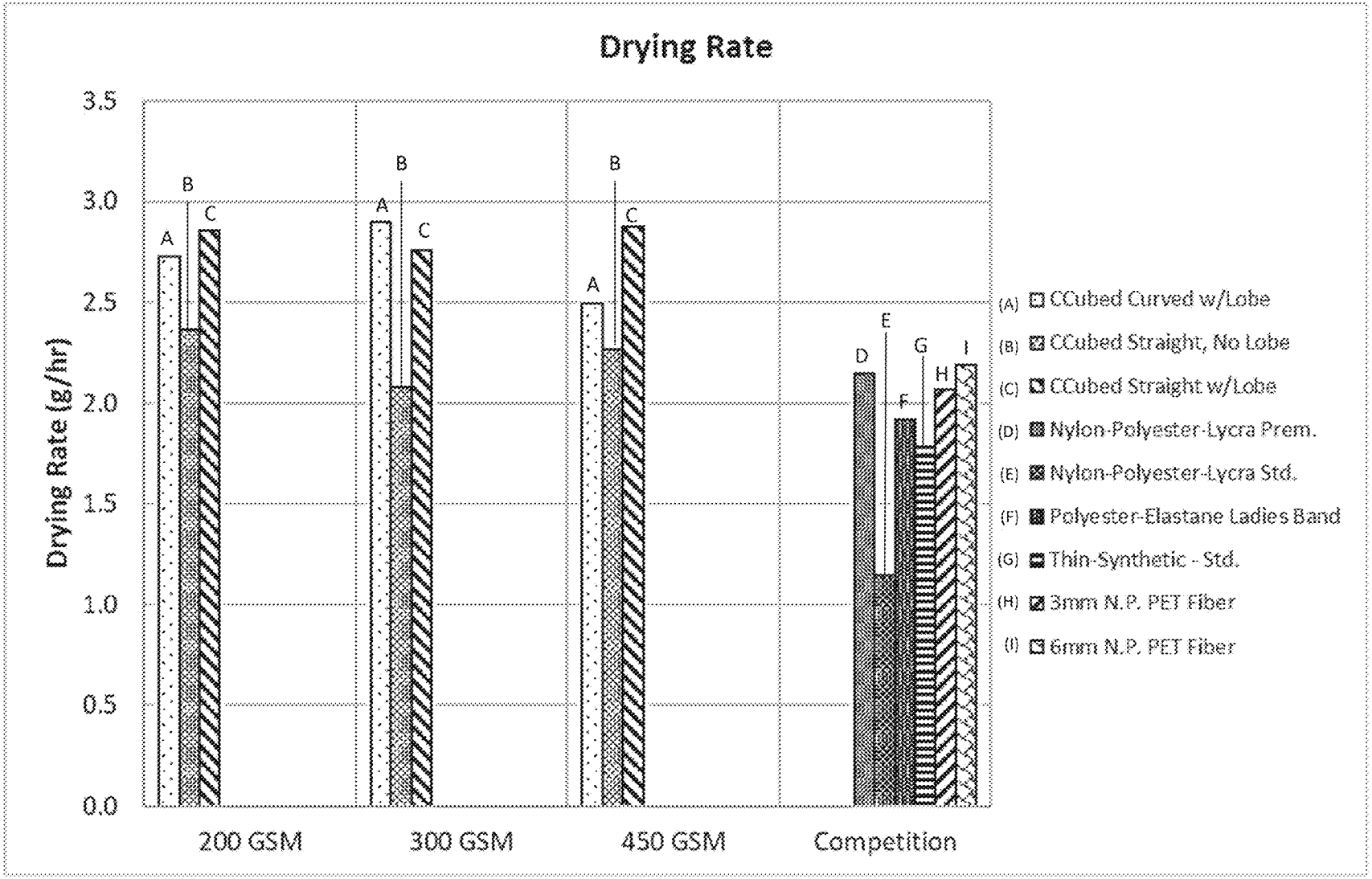
FIG. 24 is a graph of the drying rate of the materials tested using the dynamic drying test.
Figure 25:
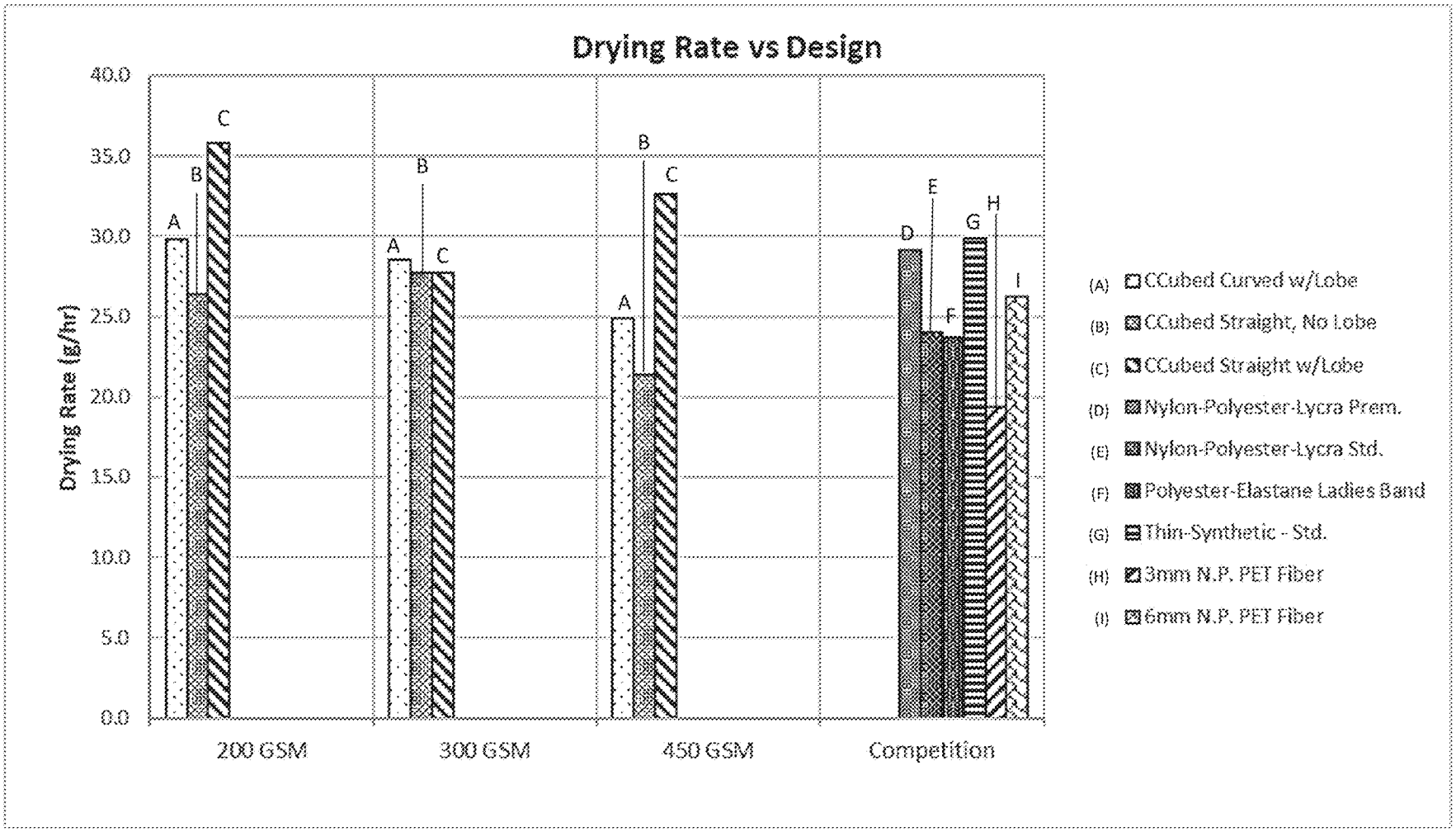
FIG. 25 is a graph of the drying rate of the materials tested using the helmet drying test.

The above tests also measure the drying rate of the materials tested. FIG. 24 shows the drying rate of the materials tested using the dynamic drying test. FIG. 25 shows the drying rate of the materials tested using the helmet drying test.

As shown in the data from FIG. 24, the drying rate is about 1/10 (or 10%) that of the drying rate data from the helmet drying test (FIG. 25). The drying rate for the materials with the CCubed designation is slightly higher than the competition mainly to the presence of the lobe. The straight, non-lobed material with the CCubed designation is similar to some of the competition materials since the size of the CCubed straight band is similar to the competition materials of similar performance.

FIG. 25 shows that more surface area (e.g., via a lobe) enables a faster drying rate. In the helmet drying test, the lobe extends toward and into helmet vent holes. Due to the exposure to air flow, performance is improved and evaporation is faster. Moisture is drawn to the areas where the vent holes are present. The straight with lobe design has more surface area than the curved with lobe design and evaporates faster. Thin, lightweight competition materials dry similarly fast as the materials with the CCubed designation due to the surface area and material chemistry, though the lobed CCubed design will dry faster due to the lobe allowing additional forced evaporation.

Sweat Management Index

The Sweat Management Index (SMI) is calculated by adding the holding capacity and the drying rate for 1 hour. The higher the SMI, the better.

Based on empirical field testing, a person sweats in the forehead area from about 20 grams/hour to about 40 grams/hour. Baker et al., *Body map of regional vs. whole body sweating rate and sweat electrolyte concentrations in men and women during moderate exercise-heat stress*, J. Appl. Physiol. 214: 1304-18 (2018), indicates that the sweating rate for a male in the forehead area is about 6 $mg/cm^2/min$, with a forehead area of about 12.5 cm×6 cm, for an approximate sweating rate of about 27 grams/hour.

Figure 26:
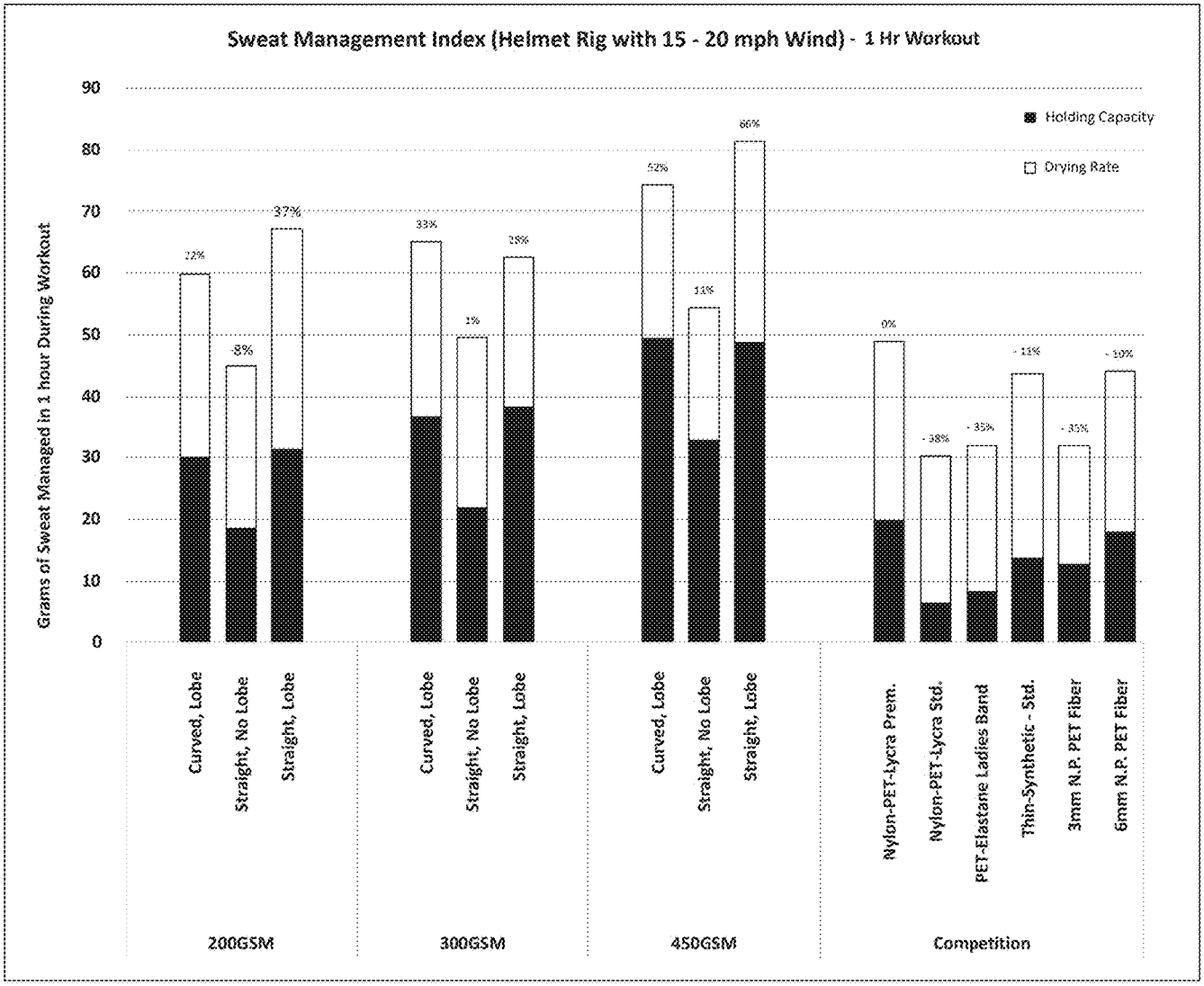
FIG. 26 is a graph of the Sweat Management Index for various materials.

FIG. 26 shows the Sweat Management Index using the holding capacity and drying rate calculated using the helmet drying test (using a helmet rig with 15-20 mph wind). The test is intended to simulate a one-hour workout. The value of the SMI is in grams of sweat managed in one hour during a workout. A benchmark value is set by the Nylon-PET-Lycra Prem. Material, and the percentages at the top of the bars indicate the percent change over the benchmark.

The results show that the holding capacity of the materials according to the present teachings is generally higher than the competition materials. The drying rate of the materials according to the present teachings is similar to the competition materials. The total Sweat Management Index of the materials according to the present teachings is higher (better) that the competition materials. This is due to the materials according to the present teachings having a higher holding capacity and the lobed design enabling more evaporation within the air vents of the helmet.

Figure 27:
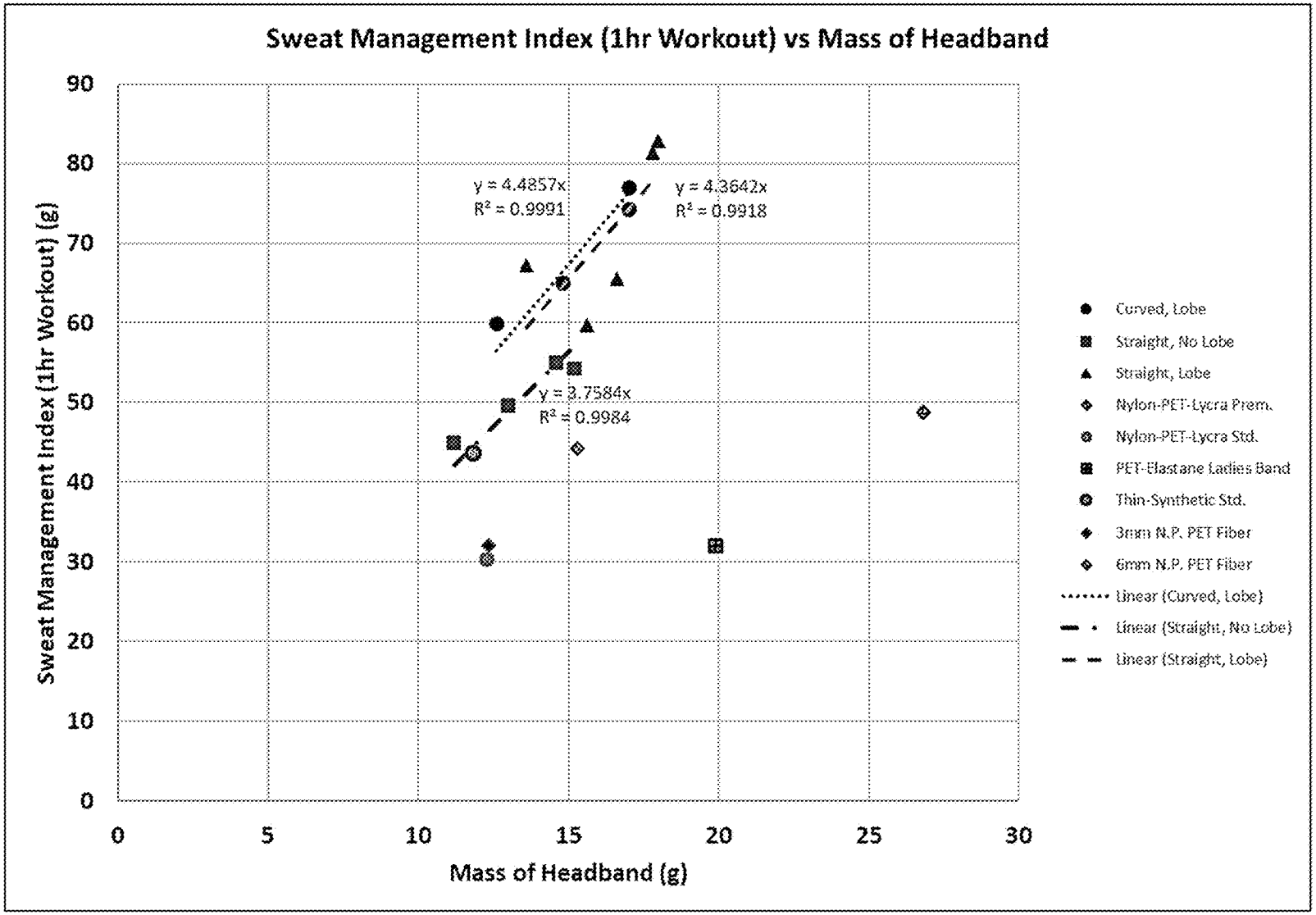
FIG. 27 is a graph of the Sweat Management Index for various materials vs the mass of the material.

FIG. 27 shows the Sweat Management Index versus the mass of the headband. The results show that the Sweat Management Index is predictable for the materials of the present teachings with the mass of the material present. Increasing the weight (gsm) will increase the SMI.

Fiber Pleat Orientation Bulk Draining Test

A Fiber Pleat Orientation Bulk Draining Test is performed to capture the maximum supersaturated liquid holding capacity, the saturated liquid holding capacity, the initial draining curve, and the start of dripping (up to 15 minutes). Maximum saturated liquid holding capacity is determined when dripping stops and the drying curve becomes a continuous monotonoic decreasing function.

This test is done in the machine direction (MD) and then against machine direction (AMD or XD) to understand the degree of anisotropy in the material as it relates to bulk draining of excess liquid. This curve is captured in real-time dynamic mode to ensure the transitions in the curve can be resolved. This is done in a controlled environment (temperature/humidity) that does not have forced air currents.

This test enables one to understand the holding capacity, the draining & dripping dynamics, and the anisotropy in the material. This information is relevant to designing a material that is made to hold a certain amount of sweat and to bulk drain it effectively as a function of orientation of the fiber structure. This is especially important when designing a cushioning and comfort padding material that may get completely soaked with liquid and it needs to drain quickly and effectively to maximize comfort and performance to the user.

To set up the test, there is a mass balance configured in dynamic mode, connected to a laptop computer via USB cable, which enables the balance to pipe mass/time data to the computer. The computer has a programmed spreadsheet which communicates to the balance to commence the test, control the acquisition rate, and to log the data (mass vs time).

Once the experiment is over, the mass vs time data is analyzed to determine the maximum supersaturated holding capacity, the draining/dripping portion of the curve, and the saturated holding capacity. Further data analysis can be done on the data.

The sample and sample holding fixture are on the balance and tared such that the balance is only reading the mass of the water in the specimen. The tray of water used to wet the specimen is off the balance and used to capture any water draining/dripping such that this water does not compromise the balance readout of the remaining water in the specimen which is being recorded in dynamic mode.

The mass balance and sample holding fixture are in an enclosed environment to control temperature/humidity fluctuations, and to minimize air currents.

To perform the test, the hanging rig is tared on the balance and the specimen is hung freely above the tray of water. The dry mass of the specimen is recorded and the balance is tared again so the balance will only read the water content in the specimen.

The water tray is raised up to submerge the specimen. The specimen is allowed to remain submerged for 15 minutes to enable maximum uptake of water. If the specimen (such as an open cellular foam) floats and won't submerge, it is physically squeezed to force all of the trapped air out so it can uptake the full amount of water.

After 15 minutes, the program on the computer is started to being the data acquisition, the water tray is quickly lowered to expose the specimen and locked in place, and the enclosure is quickly closed to allow the experiment to continue.

After 15 minutes of running, the program is stopped and the data is saved for further analysis. The starting point of the experiment is determined by analyzing the data to identify the highest mass point on the curve, with a smooth falling curve after that point. Data before that point is discarded as it will be obvious that this data occurred during the handling of the bucket of water in contact with the specimen during the commencement of the experiment.

The early part of the curved is zoomed in to determine where the sample is draining and when the dripping starts. The amount of water drained to the dripping commencement point is recorded, as is the amount of water drained after 25 sec and after 15 minutes (typically dripping stops within 5-10 minutes and the system becomes purely evaporative thereafter).

Figure 28:
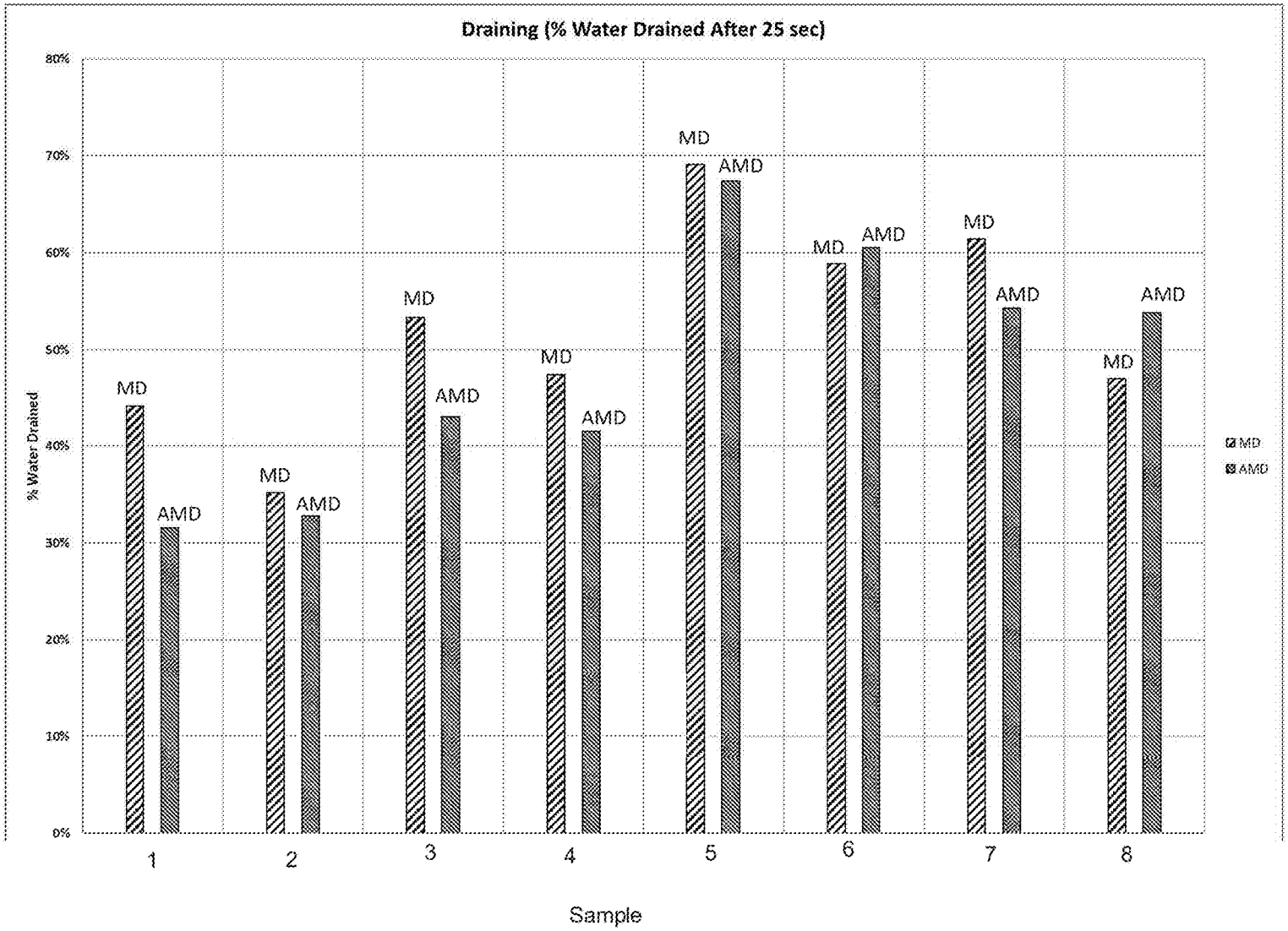
FIG. 28 shows the results of the Fiber Loop Orientation Drying Test on various materials in the machine direction and against the machine direction.

FIG. 28 shows the results of the Fiber Loop Orientation Drying Test performed with a material that is 4 inch by 4 inch square. The specimen is held vertically for the draining test. The results compare vertically lapped materials (V-Lap) and cross lapped materials (X-Lap). For each material, the drying test is performed with the fibers in the machine direction and the fibers against machine direction.

Samples 1-8 of FIG. 28 are as follows in Table 1:

TABLE 1

| Sample Number | Sample Description |
|---|---|
| 1 | V-Lap, 626 gsm, 18.1 mm |
| 2 | X-Lap, 588 gsm, 15.2 mm |
| 3 | V-Lap, 444 gsm, 18.6 mm |
| 4 | X-Lap, 438 gsm, 16.8 mm |
| 5 | V-Lap, 215 gsm, 22.9 mm |
| 6 | X-Lap, 215 gsm, 21.4 mm |
| 7 | V-Lap, 676 gsm, 26.3 mm |
| 8 | X-Lap, 643 gsm, 26.3 mm |

As is seen from the results of FIG. 28, in most cases, a higher percentage of water draining occurs during the first 25 seconds (or upon completion of the first 25 seconds) in the machine direction. The results illustrate how gravity will pull the water from the structure initially (draining), but the amount of draining and subsequent dripping is a function of the fiber three-dimensional structure (e.g., fiber size, geometry, fiber orientation, lapping type), and how well the water is binding to the surface of the fibers (e.g., hydrophilic nature of the fibers). Since the V-Lap structure is anisotropic in these properties, there is a significant difference in performance versus orientation to the force of gravity.

Air Permeability

Figure 29:
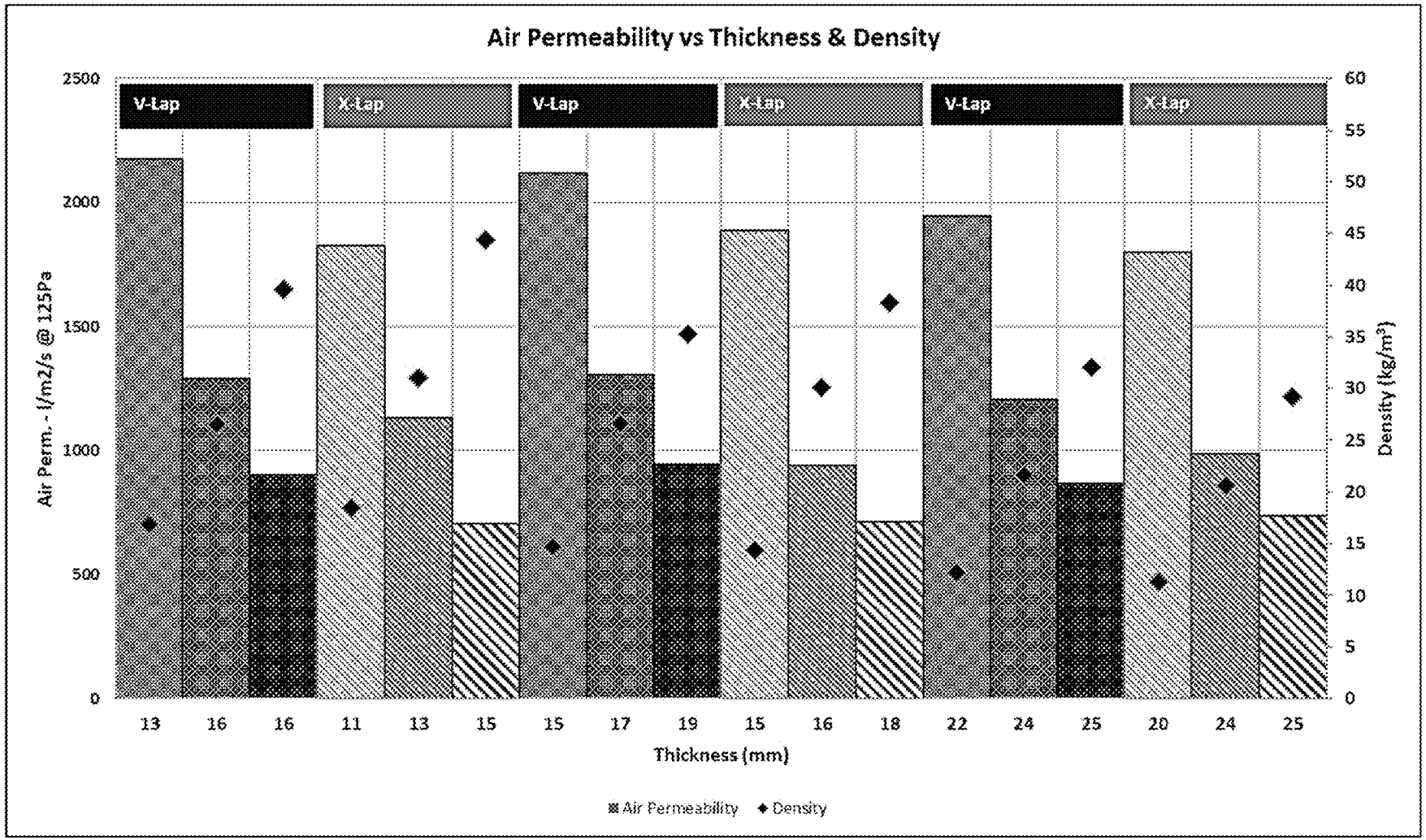
FIG. 29 shows the air permeability of various materials versus thickness and density.

FIG. 29 illustrates results of testing following ASTM D737 at 125.4 Pa to determine air permeability ($l/m^2/s$ at 125 Pa) for vertically lapped (V-Lap) and cross-lapped (X-Lap) materials of different thicknesses and densities. The densities are shown as diamonds. The thickness of each sample is shown along the x-axis of the graph. The air permeability is represented by the bars.

The results of FIG. 29 show that vertically lapped materials are more permeable than cross-lapped materials at a similar density and thickness. This is due to the vertically lapped material being more anisotropic than the cross-lapped material.

Any of the materials described herein may be combined with other materials described herein (e.g., in the same layer or in different layers of the layered material). The layers may be formed from different materials. Some layers, or all of the layers, may be formed from the same materials, or may include common materials or fibers. The type of materials forming the layers, order of the layers, number of layers, positioning of layers, thickness of layers, or a combination thereof, may be chosen based on the desired properties of each material (e.g., wicking properties, cooling properties, insulative properties, and the like), the desired air flow resistive properties of the material as a whole, the desired weight, density and/or thickness of the material, the desired flexibility of the material (or locations of controlled flexibility), or a combination thereof. The layers may be selected to provide varying orientations of fibers.

Parts by weight as used herein refers to 100 parts by weight of the composition specifically referred to. Any numerical values recited in the above application include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32, etc. are expressly enumerated in this specification. For values which are less than one, one unit is considered to be 0.0001, 0.001, 0.01, or 0.1 as appropriate. These are only examples of what is specifically intended and all possible combinations of numerical values between the lowest value, and the highest value enumerated are to be expressly stated in this application in a similar manner. Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

| Element List | |
|---|---|
| 10 | Absorbing article |
| 12 | Fibrous layer |
| 14 | Interior wicking layer |
| 16 | Exterior layer |
| 20 | Helmet |
| 22 | Forward end |
| 24 | Rearward end |
| 26 | Air vents |
| 30 | Pad |
| 32 | Body portion |
| 34 | First short edge |
| 36 | Second short edge |
| 38 | First long edge |
| 40 | First long edge segment |
| 42 | Second long edge |
| 44 | Second long edge segment |
| 46 | Ridge |
| 48 | Tabs |
| 50 | Cutouts |
| 60 | Arms of glasses |
| 70 | Headband |
| 72 | Strap |
| 80 | Moisture Reservoir |
| 82 | Gasket |
| 90 | Carded fibrous material |

-continued

| Element List | |
|---|---|
| 92 | Fibers |
| 94 | Carded and lapped fibrous material |
| 96 | Upper loop |
| 98 | Lower loop |
| $L_{Body}$ | Length of body |
| $W_{Body}$ | Width of body |
| $L_{FES}$ | Length of first edge segment |
| $L_{SES}$ | Length of second edge segment |
| $W_{B+R}$ | Width of body and ridge (max) |
| $L_{Tab}$ | Length of tab (max) |
| $W_{Tab}$ | Width of tab |
| M | Machine Direction |
| $D_{Loop}$ | Direction of loop |
| $L_A$ | Longitudinal axis |

What is claimed is:

1. An article comprising:

a multilayered material for guiding absorption and/or evaporation of moisture;

wherein the article is formed of:

a. an interior layer adapted to contact a source of moisture, wherein the source of moisture is a head, scalp, face, forehead, or a combination thereof;

b. a vertically lapped fibrous layer; and c. an air permeable exterior layer;

wherein the vertically lapped fibrous layer is sandwiched between the interior layer and the exterior layer;

wherein each layer of the article is permeable;

wherein each edge of the article is compressed and heat sealed to bond two or more of the layers together;

wherein the vertically lapped fibrous layer has a gradient density structure, wherein through a thickness of the vertically lapped fibrous layer, the density increases from one surface to an opposing surface;

wherein the article is adapted to absorb and/or wick away perspiration;

wherein the article is adapted to provide cushioning;

wherein the article is reusable; and wherein the article is adapted to be worn as headwear, worn with headwear, and/or inserted into headwear.

2. The article of claim 1, wherein the article is adapted to be worn with and/or inserted into headwear.

3. The article of claim 1, wherein the article is an insert for a helmet.

4. The article of claim 1, wherein the article is integrated into a helmet.

5. The article of claim 1, wherein the article includes an elongated body portion and one or more extension features extending from the body portion and adapted to extend toward a crown of the head of a wearer for guiding absorption and/or evaporation of moisture.

6. The article of claim 1, wherein the article is a shaped three-dimensional structure.

7. The article of claim 1, wherein the interior layer is a wicking layer, the exterior layer is a wicking layer, or both.

8. The article of claim 1, wherein each upper loop and each lower loop of the vertically lapped fibrous layer extends in a direction generally perpendicularly to a longitudinal axis of the article, generally perpendicular to a machine direction, or both, and wherein the upper loops form the one surface of the vertically lapped fibrous layer and the lower loops form the opposing surface of the vertically lapped fibrous layer.

9. The article of claim 1, wherein prior to lapping, the vertically lapped fibrous layer is formed of a carded web with fibers oriented in a machine direction.

10. The article of claim 1, wherein the edges of the interior layer and exterior layer are sealed to encapsulate the vertically lapped fibrous layer.

11. The article of claim 1, wherein the vertically lapped fibrous layer has a greater density at a surface that is adapted to face away from the wearer to increase moisture evaporation rate at the surface.

12. The article of claim 1, wherein the article or one or more layers thereof is thermoformable to allow the article to be formed into a desired shape.

13. The article of claim 1, wherein the article is washable without losing shape, resilience, wicking properties, drying properties, antimicrobial properties, or a combination thereof.

14. The article of claim 1, wherein the article is configured to exhibit antimicrobial characteristics, antifungal characteristics, odor resistance, or a combination thereof.

15. The article of claim 1, wherein an edge of the article includes a moisture reservoir attached thereto or integrally formed with the edge to guide moisture in a particular direction.

16. An article of headwear comprising the article of claim 1, wherein the article of headwear is a headband or helmet.

17. The article of headwear of claim 16, wherein the article of headwear is a cycling helmet or a motorsports helmet.

18. An article comprising:

a multilayered material for guiding absorption and/or evaporation of moisture;

wherein the article is formed of:

a. an interior layer adapted to contact a source of moisture, wherein the source of moisture is a head, scalp, face, forehead, or a combination thereof;

b. a vertically lapped fibrous layer, wherein the vertically lapped fibrous layer has a gradient density structure, wherein through a thickness of the vertically lapped fibrous layer, the density increases from one surface to the opposing surface; and c. an exterior layer;

wherein each layer of the article is breathable;

wherein the article is adapted to be worn with and/or inserted into a helmet having one or more air vents;

wherein the article includes an elongated body portion and one or more extension features extending from the body portion for guiding wicking, absorption, and/or evaporation of moisture;

wherein the one or more extension features are adapted to extend toward a crown of the head of a wearer;

wherein the one or more extension features are adapted to be positioned at or near at least one of the one or more air vents of the helmet;

wherein the vertically lapped fibrous layer is sandwiched between the interior layer and the exterior layer;

wherein each edge of the article is compressed and heat sealed to bond the layers together and/or encapsulate the vertically lapped fibrous layer; and wherein the article is reusable.

19. The article of claim 18, wherein the article is adapted to provide cushioning.

20. The article of claim 18, wherein the vertically lapped fibrous layer has a greater density at a surface that is adapted to face away from the wearer.

* * * * *